US007283967B2

(12) United States Patent
Nishio et al.

(10) Patent No.: US 7,283,967 B2
(45) Date of Patent: Oct. 16, 2007

(54) ENCODING DEVICE DECODING DEVICE

(75) Inventors: Kosuke Nishio, Moriguchi (JP); Mineo Tsushima, Katano (JP); Naoya Tanaka, Neyagawa (JP); Takeshi Norimatsu, Kobe (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 878 days.

(21) Appl. No.: 10/285,609

(22) Filed: Nov. 1, 2002

(65) Prior Publication Data

US 2003/0088328 A1 May 8, 2003

(30) Foreign Application Priority Data

Nov. 2, 2001 (JP) ..... 2001-337869
Nov. 30, 2001 (JP) ..... 2001-367008
Dec. 14, 2001 (JP) ..... 2001-381807

(51) Int. Cl.
*G10L 19/00* (2006.01)

(52) U.S. Cl. ..... 704/500; 704/501; 704/205; 704/222; 704/224

(58) Field of Classification Search ..... 704/500, 704/501, 205, 222, 224
See application file for complete search history.

(56) References Cited

U.S. PATENT DOCUMENTS 4,771,465 A * 9/1988 Bronson et al. ..... 704/207
4,776,014 A * 10/1988 Zinser, Jr. ..... 704/262
5,522,009 A 5/1996 Laurent
5,592,584 A 1/1997 Ferreira et al.
5,737,718 A * 4/1998 Tsutsui ..... 704/205
6,097,880 A 8/2000 Koyata
6,351,730 B2 * 2/2002 Chen ..... 704/229
6,356,639 B1 3/2002 Ishito et al.

(Continued)

FOREIGN PATENT DOCUMENTS

JP 06-027998 2/1994

(Continued)

OTHER PUBLICATIONS

ISO/IEC JTC1/SC29/WG11 IS 13818-7, "Information technology—Generic coding of moving pictures and associated audio information", Part 7: Advanced Audio Coding (AAC), First edition Dec. 1, 1997.

(Continued)

*Primary Examiner*—Richemond Dorvil
*Assistant Examiner*—Leonard Saint-Cyr
(74) *Attorney, Agent, or Firm*—Wenderoth, Lind & Ponack, L.L.P.

(57) ABSTRACT

An encoding device (100) includes (i) a first encoding unit (132) that encodes spectral data in the lower frequency band represented by a plularity of parameters, out of the spectral data obtained by transforming an audio signal inputted for a fixed time length, (ii) a second quantizing unit (133) that generates sub information representing characteristics of the spectral data in the higher frequency by fewer parameters than those for the lower frequency band, out of the spectral data obtained by the transformation, (iii) a second encoding unit (134) that encodes the generated sub information, and (iv) a stream output unit (140) that outputs the data encoded by the first encoding unit (132) and the data encoded by the second encoding unit (134).

4 Claims, 22 Drawing Sheets

U.S. PATENT DOCUMENTS

| | | | |
|---|---|---|---|
| 6,678,653 | B1 | 1/2004 | Tsushima et al. |
| 6,711,538 | B1 | 3/2004 | Omori et al. |
| 6,823,310 | B2 | 11/2004 | Ishito et al. |
| 6,826,526 | B1 | 11/2004 | Norimatsu et al. |
| 6,904,404 | B1 | 6/2005 | Norimatsu et al. |
| 2002/0035407 | A1 | 3/2002 | Ishito et al. |
| 2005/0060147 | A1 | 3/2005 | Norimatsu et al. |

FOREIGN PATENT DOCUMENTS

| | | |
|---|---|---|
| JP | 63-33025 | 2/1998 |
| JP | 10-65546 | 3/1998 |
| JP | 10-340099 | 12/1998 |
| JP | 11-30998 | 2/1999 |
| JP | 2000-137497 | 5/2000 |
| JP | 2001-100773 | 4/2001 |
| JP | 2001-148632 | 5/2001 |
| JP | 2001-154698 | 6/2001 |
| JP | 2001-166800 | 6/2001 |
| JP | 2001-188563 | 7/2001 |
| JP | 2001-296893 | 10/2001 |
| WO | 98/57436 | 12/1998 |
| WO | 00/45379 | 8/2000 |

OTHER PUBLICATIONS

Co-pending Appl. No. 10/285,633, filed Nov. 1, 2002, entitled "Encoding Device and Decoding Device".

Co-pending Appl. No. 10/285,627, filed Nov. 1, 2002, entitled "Encoding Device, Decoding Device and Audio Data Distribution System".

Co-pending Appl. No. 10/140,881, filed May 9, 2002, entitled "Encoding Device, Decoding Device, and Broadcast Sysem".

M. Bosi et al., "I*SO/IEC MPEG-2 Advanded Audio Coding*", Journal of the Audio Engineering Society, Audio Engineering Society, New York, U.S., vol. 45, No. 10, Oct. 1, 1997, pp. 789-812.

A. McCree, "*A 14KB/S Wideband Speech Coder With a Parametic Highband Mode*l", 2000 IEEE International Congerence on Acoustics, Speech, and Signal Processing. Proceeding (CAT. No. 00CH37100), Jun. 5-9, 2000, Istanbul, Turkey.

* cited by examiner

ENCODING DEVICE DECODING DEVICE

TECHNICAL FIELD

The present invention relates to technology for encoding and decoding digital audio data to reproduce high-quality sound.

BACKGROUND ART

In recent years, a variety of audio compression methods have been developed. MPEG-2 Advanced Audio Coding (AAC) is one of such compression methods, and is defined in detail in "ISO/IEC 13818-7 (MPEG-2 Advanced Audio Coding, AAC)".

First, the conventional encoding and decoding procedures will be described below using FIG. 1. FIG. 1 is a block diagram showing a configuration of an encoding device 300 and a decoding device 400 according to the conventional MPEG-2 AAC method. The encoding device 300 is a device that compresses and encodes an inputted audio signal based on MPEG-2 AAC, and includes an audio signal input unit 310, a transforming unit 320, a quantizing unit 331, an encoding unit 332 and a stream output unit 340.

The audio signal input unit 310 divides digital audio data that is an input signal into every contiguous 1,024 samples at a sampling frequency of 44.1 kHz, for instance. This encoding unit of 1,024 samples is called a "frame".

The transforming unit 320 performs Modified Discrete Cosine Transform (MDCT) on the sample data in the time domain divided by the audio signal input unit 310 into spectral data in the frequency domain. This spectral data of 1,024 samples transformed at this point in time is then divided into a plurality of groups, and each of the groups is set so as to include the spectral data of one or more samples. Also, each of the groups simulates a critical band of human hearing, and is called a "scale factor band".

The quantizing unit 331 quantizes the spectral data produced from the transforming unit 320 into a predetermined number of bits. According to MPEG-2 AAC, the quantizing unit 331 quantizes the spectral data in the scale factor band using one normalizing factor for every scale factor band. This normalizing factor is called a scale factor. Also, the result of quantizing each spectral data with each scale factor is called a "quantized value". The encoding unit 332 encodes the data quantized by the quantizing unit 331 and the spectral data quantized using the scale factor in accordance with Huffman coding. The data quantized by the quantizing unit 331 is a scale factor. Before doing so, the encoding unit 332 calculates a differential in values of two scale factors of every two contiguous scale factor bands in one frame, and encodes the differential and the scale factor of the first scale factor band in accordance with Huffman coding.

The stream output unit 340 transforms the encoding signal produced from the encoding unit 332 into an MPEG-2 AAC bit stream and outputs it. The bit stream outputted from the encoding device 300 is transmitted to the decoding device 400 via a transmission medium, or recorded on a recording medium, such as an optical disc including a compact disc (CD) and a digital versatile disc (DVD), a semiconductor, and a hard disk.

The decoding device 400 is a device that decodes the bit stream encoded by the encoding device 300, and includes a stream input unit 410, a decoding unit 421, a dequantizing unit 422, an inverse-transforming unit 430 and an audio signal output unit 440.

The stream input unit 410 receives the bit stream encoded by the encoding device 300 via a transmission medium or via a recording medium, and reads out the encoded signal from the received bit stream. The decoding unit 421 then decodes the read-out encoded signal to produce a quantized value.

The dequantizing unit 422 dequantizes the quantized value decoded by the decoding unit 421. In MPEG-2 AAC, the decoding unit 421 decodes the data encoded in accordance with Huffman coding. The inverse-transforming unit 430 transforms the spectral data in the frequency domain produced by the dequantizing unit 422 into the sample data in the time domain. In MPEG-2 AAC, this is performed by Inverse Modified Discrete Cosine Transform (IMDCT). The audio signal output unit 440 combines the sample data in the time domain produced by the inverse-transforming unit 430 in sequence, and outputs the sets of sample data as digital audio data.

In actual MPEG-2 AAC encoding, other techniques are additionally used, which include gain control, Temporal Noise shaping (TNS), a psychoacoustic model, M/S (Mid/Side) stereo, intensity stereo, prediction, and a bit reservoir.

The quality of the audio data encoded according to the above-mentioned method can be measured, for instance, by a reproduction band of the audio data after encoding. When an input signal is sampled at a 44.1-kHz sampling frequency, for instance, a reproduction band of this signal is 22.05 kHz. When the audio signal with the 22.05-kHz reproduction band or a wider reproduction band close to 22.05 kHz is encoded into encoded audio data without degradation, and the data amount is fitted to the available transmission rate, then this audio data can be reproduced as high-quality sound. The width of a reproduction band, however, affects the number of spectral data values, which in turn affects the data amount for transmission. For instance, when an input signal is sampled at the sampling frequency of 44.1 kHz, spectral data generated from this signal is composed of 1,024 samples, which has the 22.05-kHz reproduction band. In order to secure the 22.05-kHz reproduction band, all the 1,024 samples of the spectral data need to be transmitted.

It is not realistic, however, to transmit as many as 1,024 samples of the spectral data via a low-rate transmission channel of, for instance, cell phones. This is to say, when all the spectral data with a wide reproduction band is transmitted at such a low transmission rate while the size of the entire spectral data is adjusted for the low transmission rate, a data size assigned to each frequency band becomes extremely small. This intensifies effect of quantization noise, so that sound quality deteriorates through encoding.

In order to prevent such degradation, efficient audio signal transmission is achieved in many of audio signal encoding methods including MPEG-2 AAC by assigning weights to values of the spectral data and not transmitting low-weighted values. As for the reproduction band, with this method, sufficient data size is assigned to spectral data in a lower frequency band, which is important for human hearing, to enhance its encoding accuracy, while spectral data in a higher frequency band is regarded as less important and is unlikely to be transmitted.

Although such techniques are used in MPEG-2 AAC, audio encoding technology that achieves higher-quality reproduction and more efficient compression is now required. In other words, there is an increasing demand for technology of transmitting an audio signal in a higher frequency band as well as a lower frequency band at a low transmission rate.

The object of the present invention is to provide an encoding device and a decoding device that can realize encoding and decoding of an audio signal to reproduce high-quality sound without substantially increasing an amount of encoded data.

SUMMARY OF THE INVENTION

In order to achieve the above object, the encoding device according to the present invention is an encoding device that encodes an inputted audio signal, and includes: a first encoding unit operable to encode spectral data in a lower frequency band out of the spectral data which is obtained by transforming the audio signal inputted for a fixed time length and divided into a plurality of groups, the spectral data in the lower frequency band being represented by four kinds of parameters; (1) a normalizing factor for normalizing the spectral data in each of the groups, (2) a quantized value obtained by quantizing the spectral data in each group using the normalizing factor, (3) a positive or negative sign indicating a phase of the spectral data in each group, and (4) a position of the spectral data in each group in a frequency domain; a sub information generating unit operable to generate sub information including (1) specification information for specifying spectral data in the lower frequency band which is approximate to the spectral data in each group in a higher frequency band and (2) correction information indicating a characteristic of the spectral data in the higher frequency band which is represented by three or less kinds of parameters out of the four parameters as information for correcting the specified spectral data in the lower frequency band; a second encoding unit operable to encode the generated sub information; and an outputting unit operable to output the data encoded by the first encoding unit and the data encoded by the second encoding unit.

In the encoding device according to the present invention, the sub information generating unit generates the sub information representing the characteristics of the spectral data in the higher frequency band by fewer parameters than that of the lower frequency band, out of the spectral data obtained by transforming the audio signal inputted for the fixed time length, and the second encoding unit encodes the generated sub information.

Accordingly to the encoding device of the present invention, the spectral data in the higher frequency band is not quantized and encoded as it is, but the sub information representing the characteristics of the spectral data in the higher frequency band by the fewer parameters than that of the lower frequency band is encoded. Therefore, there is an effect that the spectral data in the higher frequency band can be encoded with a very little amount of data, compared with that in the lower frequency band. Also, according to the conventional MPEG-2 AAC, the audio signals all over the bandwidth are encoded by the same method, so it is difficult to transmit the information in the higher frequency band at a low transfer rate. However, according to the encoding device of the present invention, the information in the higher frequency band can be transmitted without substantially increasing the amount of information after encoding, so there is an effect that the decoding device of the present invention can decode the audio signal to reproduce higher-quality sound in the higher frequency band than the conventional decoding device.

Also, in the decoding device of the present invention, the sub information generating unit may generate the normalizing factor which is calculated so that a value obtained by quantizing peak spectral data in each group in the higher frequency band becomes a fixed value, as the correction information.

Also, the sub information generating unit may quantize a value of peak spectral data in each group in the higher frequency band using a normalizing factor common to each group, and generate the quantized value as the correction information.

According to the encoding device of the present invention, the quantized value of the spectral data which is a normalizing factor or a peak, each of which is one parameter for each group (scale factor band) in the higher frequency band, is generated as the sub information, so the data amount of the sub information is very little even if a certain number of bits, 8 bits, for instance, is assigned to represent one normalizing factor or quantized value. Therefore, the maximum amplitude of the spectral data for each group in the higher frequency band can be roughly represented with a small amount of data. As a result, according to the encoding device of the present invention, the information for generating the audio signals in the higher frequency band to reproduce the original sound can be transmitted with only a very little more transmission amount than the conventional one, even via a transmission channel at a low transmission rate. That is, there is an effect that the decoding device of the present invention can reconstruct the audio signals to reproduce the original sound with more fidelity.

Also, in the encoding device of the present invention, the sub information generating unit may generate a frequency position of peak spectral data in each group in the higher frequency band, as the correction information.

Also, the spectral data is an MDCT coefficient, and the sub information generating unit may generate a sign indicating positive or negative of spectral data at a predetermined frequency position in the higher frequency band, as the correction information.

According to the encoding device of the present invention, a rough spectral shape in each group (scale factor band) in the higher frequency band can be represented with a little amount of data by the frequency position of the peak spectral data or the positive or negative sign of the spectral data at a predetermined frequency position in the higher frequency band. Therefore, there is an effect that the copied spectral data can be corrected so as to be approximate to the spectral data in the higher frequency band with accuracy.

Also, in the encoding device of the present invention, the sub information generating unit may generate information specifying a spectrum in the lower frequency band which is most approximate to a spectrum of spectral data in each group in the higher frequency band, as the specification information.

According to the encoding device of the present invention, when there is in the lower frequency band a spectrum of a shape closely similar to that of the spectrum in the higher frequency band, the spectrum in the lower frequency band may be specified and copied to the higher frequency band. Therefore, there is an effect that the spectrum in the higher frequency band can be represented with more fidelity, with a very small amount of data.

The present invention can be realized as a broadcast system including a sending device having the encoding device of the present invention and a receiving device having the decoding device of the present invention, as an encoding method and a decoding method including the processing steps which are the characteristic components of the encoding device and the decoding device, or as a program for causing a computer to function these steps.

Furthermore, it is, of course, possible to distribute the program via a computer-readable recording medium such as CD-ROM or a transmission medium such as a communication channel.

BRIEF DESCRIPTION OF DRAWINGS

These and other objects, advantages and features of the invention will become apparent from the following description thereof taken in conjunction with the accompanying drawings that illustrate a specific embodiment of the invention. In the Drawings.

DETAILED DESCRIPTION OF THE INVENTION

Figure 1:
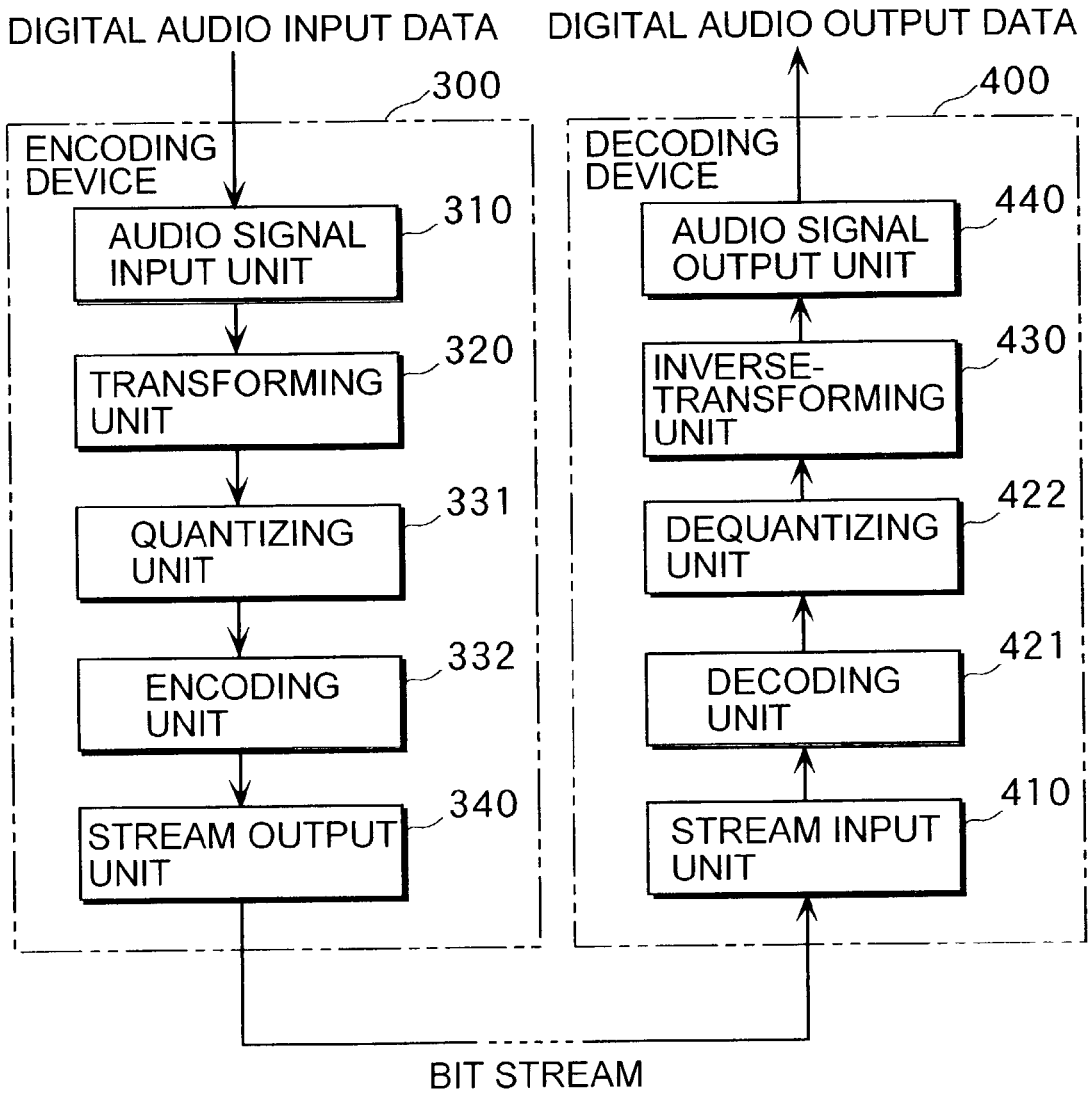
FIG. 1 is a block diagram showing a configuration of the encoding device and the decoding device according to the conventional MPEG-2 AAC method.
Figure 2:
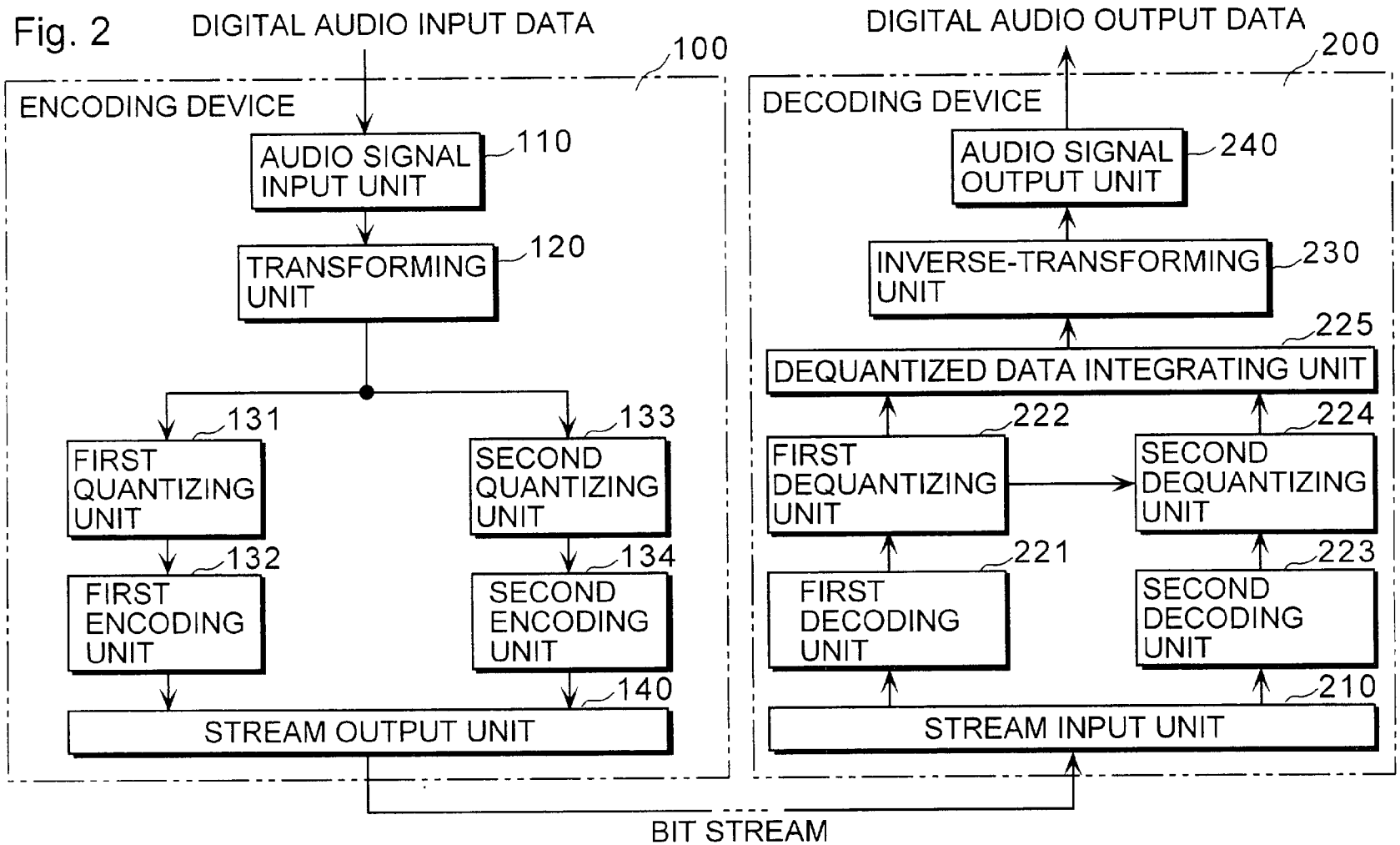
FIG. 2 is a block diagram showing a configuration of an encoding device and a decoding device according to the present embodiment.

The encoding device 100 and the decoding device 200 according to an embodiment of the present invention will be explained in detail below, with reference to the figures. Also, the present embodiment will be explained by taking MPEG-2 AAC as an example. FIG. 2 is a block diagram showing the configuration of the encoding device 100 and the decoding device 200 according to the embodiment of the present invention.

(Encoding Device 100)

The encoding device 100, when receiving an audio signal, compresses and encodes the audio signal in the lower frequency band according to MPEG-2 AAC. In addition, it generates sub information indicating characteristics of the audio signal in the higher frequency band, compresses and encodes it, integrates it into the encoded bit stream in the lower frequency band, and outputs it. The encoding device 100 includes an audio signal input unit 110, a transforming unit 120, a first quantizing unit 131, a first encoding unit 132, a second quantizing unit 133, a second encoding unit 134 and a stream output unit 140.

The audio signal input unit 110 receives digital audio data sampled at a sampling frequency of 44.1 kHz, as is the case with MPEG-2 AAC. The audio signal input unit 110 divides this digital audio data into contiguous 1,024 samples at every approximately 22.7 msec with two sets of 512 samples obtained before and after the 1,024 samples being overlapped.

The transforming unit 120 transforms this sample data in the time domain divided by the audio signal input unit 110 into spectral data in the frequency domain. In more detail, in MPEG-2 AAC, the transforming unit 120 performs MDCT (Modified Discrete Cosine Transform) on the sample data composed of 2,048 samples in the time domain, which is obtained by overlapping two sets of 512 samples before and after the 1,024 samples, to generate spectral data that also includes 2,048 samples. The samples of this spectral data generated according to MDCT are symmetrically arranged, and therefore only a half (i.e., 1,024 samples) of them are encoded.

The transforming unit 120 then divides the transformed spectral data composed of 1,024 samples into a plurality of scale factor bands, each of which contains spectral data composed of at least one sample (or, practically speaking, samples whose total number is a multiple of four). In MPEG-2 AAC, the number of samples of spectral data contained in each scale factor band is defined according to its frequencies. A scale factor band of lower frequency band is delimited narrowly by less spectral data, and a scale factor band of a higher frequency band is delimited widely by more spectral data. In MPEG-2 AAC, the number of scale factor bands corresponding to spectral data of one frame is also defined according to sampling frequencies. When sampling frequency is 44.1 kHz, for instance, each frame contains 49 scale factor bands, and the 49 scale factor bands contains spectral data of 1,024 samples. On the other hand, it is not particularly defined which scale factor band is to be transmitted among these scale factor bands, and the most desirable scale factor band, which is selected according to the transmission rate of a transmission channel, may be transmitted. When the transmission rate is 96 kbps, for instance, only the 40 scale factor bands (640 samples) in a lower frequency band in one frame may be selectively transmitted.

The present embodiment will be explained on the assumption that the transforming unit 120 divides transformed spectral data into scale factor bands whose delimitation and number are uniquely defined.

The first quantizing unit 131 receives the spectral data outputted from the transforming unit 120, and determines a scale factor for each scale factor band of a lower frequency band of that spectral data, quantizes the spectrum in the scale factor band with the determined scale factor, and outputs the quantized spectral data (hereinafter called "quantized value") to the first encoding unit 132. In this case, for instance, the sampling frequency of the received audio signal is 44.1 kHz, so the reproduction band is 22.05 kHz. For the lower frequency band, or the band of 11.025 kHz or less, for instance, the first quantizing unit 131 calculates a scale factor so that the quantized value obtained from the spectral data in each scale factor is represented as a numeric value of 4 bits or less, normalizes each spectrum in the scale factor band using the calculated scale factor, and then quantizes it.

The first encoding unit 132 encodes the data quantized by the first quantizing unit 131, that is, the quantized value in each scale factor band corresponding to the spectral data of 512 samples in the lower frequency band among all the spectral data and the scale factor used for the quantization, in accordance with Huffman coding, and transforms the encoded value to generate a first encoded signal in a predetermined stream format.

The second quantizing unit 133 receives the spectral data outputted from the transforming unit 120, calculates only the frequency band which is not quantized by the first quantizing unit 131, that is, the sub information in the higher frequency band of more than 11.025 kHz, and outputs it.

Sub information is simplified information indicating an audio signal in the higher frequency band that is calculated based on spectral data in the higher frequency band and is not transmitted in the conventional method. In other words, it is information indicating characteristics of the spectral data in higher frequency band among those obtained by transforming the audio signals received for a fixed time length. More specifically, the sub information is (1) a scale factor for every scale factor band in the higher frequency band, which derives the quantized value "1" of the absolute maximum spectral data (the spectral data whose absolute value is maximum), and its quantized value, (2) a position of the absolute maximum spectral data in each scale factor band, (3) a quantized value the higher frequency band if a scale factor common to the scale factor bands is determined, (4) a sign indicating whether the spectrum at a predetermined position in the higher frequency band is negative or positive, (5) information indicating how to copy a spectrum in a lower frequency band similar to that in a higher frequency band so as to represent a spectrum in the higher frequency band, and others. Noise information indicating amplitude of a white noise or the like which interferes over the whole frequency band from lower through higher frequencies may be added to the above-mentioned sub information.

The second encoding unit 134 encodes the sub information outputted from the second quantizing unit 133 in accordance with Huffman coding, and outputs a second encoded signal in a predetermined stream format.

The stream output unit 140 adds header information and other necessary sub information to the above first encoded signal outputted from the first encoding unit 132, and transforms it into an MPEG-2 ACC bit stream. The stream output unit 140 also records the second encoded signal outputted from the second encoding unit 134 into areas of the above bit stream which are ignored by a conventional decoding device or for which operation is undefined.

More specifically, the stream output unit 140 stores the encoded signal outputted from the second encoding unit 134 in Fill Element or Data Stream Element of the MPEG-2 ACC bit stream.

The bit stream outputted from the encoding device 100 is transmitted to the decoding device 200 via a transmission medium, or recorded on a recording medium, such as an optical disc including a CD and a DVD, a semiconductor, and a hard disk.

In MPEG-2 AAC, a length of MDCT-performed data can be changed depending upon an inputted audio signal. The transformed data with a length of 2,048 samples is called a LONG block, and the data with a length of 256 samples is called a SHORT block. These lengths are called a block size. The LONG block will be explained in the present embodiment if there is no other specific description, but the same processing can be performed for the SHORT block.

Furthermore, in the additional encoding processing in MPEG-2 AAC, tools such as Gain Control, TNS (Temporal Noise Shaping), a psychoacoustic model, M/S (Mid/Side) Stereo, Intensity Stereo and Prediction, a change of a block size, a bit reservoir, etc. could be used.

(Decoding Device 200)

The decoding device 200 is a device that reconstructs audio data of wide band added with that in the higher frequency band based on the sub information from the received encoded bit stream, and includes a stream input unit 210, a first decoding unit 221, a first dequantizing unit 222, a second decoding unit 223, a second dequantizing unit 224, a dequantized data integrating unit 225, an inverse-transforming unit 230 and an audio signal output unit 240.

On receiving the encoded bit stream generated in the encoding device 100 via a transmission medium or by reproduction from a recording medium, the stream input unit 210 reads out a first encoded signal stored in an area which should be decoded by a conventional decoding device and a second encoded signal stored in an area which is ignored by the conventional decoding device or for which operation is undefined, and outputs them to the first decoding unit 221 and the second decoding unit 223, respectively.

The first decoding unit 221 receives the first encoded signal outputted from the stream input unit 210, and then decodes the Huffman-coded data in a stream format to be reconstructed as the quantized data. The first dequantizing unit 222 dequantizes the quantized data decoded by the first decoding unit 221, and outputs the spectral data in the lower frequency band. Here, the number of samples of the spectral data outputted from the first dequantizing unit 222 is 512

(the maximum number of samples is 1024), and they represent the reproduction bandwidth of 11.025 kHz (the maximum reproduction bandwidth is 22.05 kHz).

The second decoding unit 223 receives the second encoded signal outputted from the stream input unit 210, and decodes the received second encoded signal, and then outputs sub information. The second dequantizing unit 224 generates noise, such as a copy of a part or all of spectral data in the lower frequency band, or white noise or pink noise, according to the procedure predetermined based on the spectral data outputted from the first dequantizing unit 222, shapes the noise based on the sub information outputted from the second decoding unit 223, and outputs the spectral data in the higher frequency band.

More specifically, the second dequantizing unit 224 copies in advance the spectral data in the lower frequency band outputted by the first dequantizing unit 222 to the higher frequency band, and then reconstructs the spectra in the higher frequency band by multiplying the quantized value of each spectral data within the scale factor band by a ratio between the absolute maximum value of the spectral data copied in each band in the higher frequency band and the value obtained by dequantizing the quantized value "1" using the scale factor value corresponding to the band described in the sub information, as a coefficient. Further, the second dequantizing unit 224 generates in advance white noise having a predetermined amplitude, adjusts the amplitude according to the noise information in the sub information, adds it to the reconstructed spectra, and outputs the spectral data in the higher frequency band.

The dequantized data integrating unit 225 integrates the spectral data outputted by the first dequantizing unit 222 and the spectral data outputted by the second dequantizing unit 224. In accordance with MPEG-2 AAC, the inverse-transforming unit 230 performs IMDCT on the spectral data in the frequency domain outputted from the dequantized data integrating unit 225 into the sample data comprised of 1,024 samples in the time domain. The audio signal output unit 240 combines sets of sample data in the time domain transformed by the inverse-transforming unit 230 with one another, and outputs it as digital audio data.

According to the present embodiment, data in the lower frequency band is encoded in a conventional manner and that in the higher frequency band is encoded with an extremely small amount of information, and therefore, a high-quality audio signal can be encoded within a range of a little more total amount of information than the conventional one.

Also, the encoding device 100 and the decoding device 200 according to the present embodiment are constructed just by adding the second quantizing unit 133 and the second encoding unit 134 to the conventional encoding device 300 and adding the second decoding unit 223 and the second dequantizing unit 224 to the conventional decoding device 400. Therefore, there is an effect that they can be realized without making major changes of the conventional encoding device 300 and decoding device 400.

Furthermore, there is an effect that the bit stream generated by the encoding device 100 of the present embodiment can also be decoded by the conventional decoding device 400.

The present embodiment has been explained by taking MPEG-2 AAC as an example, but it is obvious that the present embodiment may be applied to other audio encoding methods including new audio encoding methods which are to be developed in the future.

In the present embodiment, the data inputted into the second quantizing unit 133 is the spectral data only outputted from the transforming unit 120, but the present invention is not limited to this, and the value obtained by dequantizing the output from the first quantizing unit 131 may be inputted separately.

Figure 3:
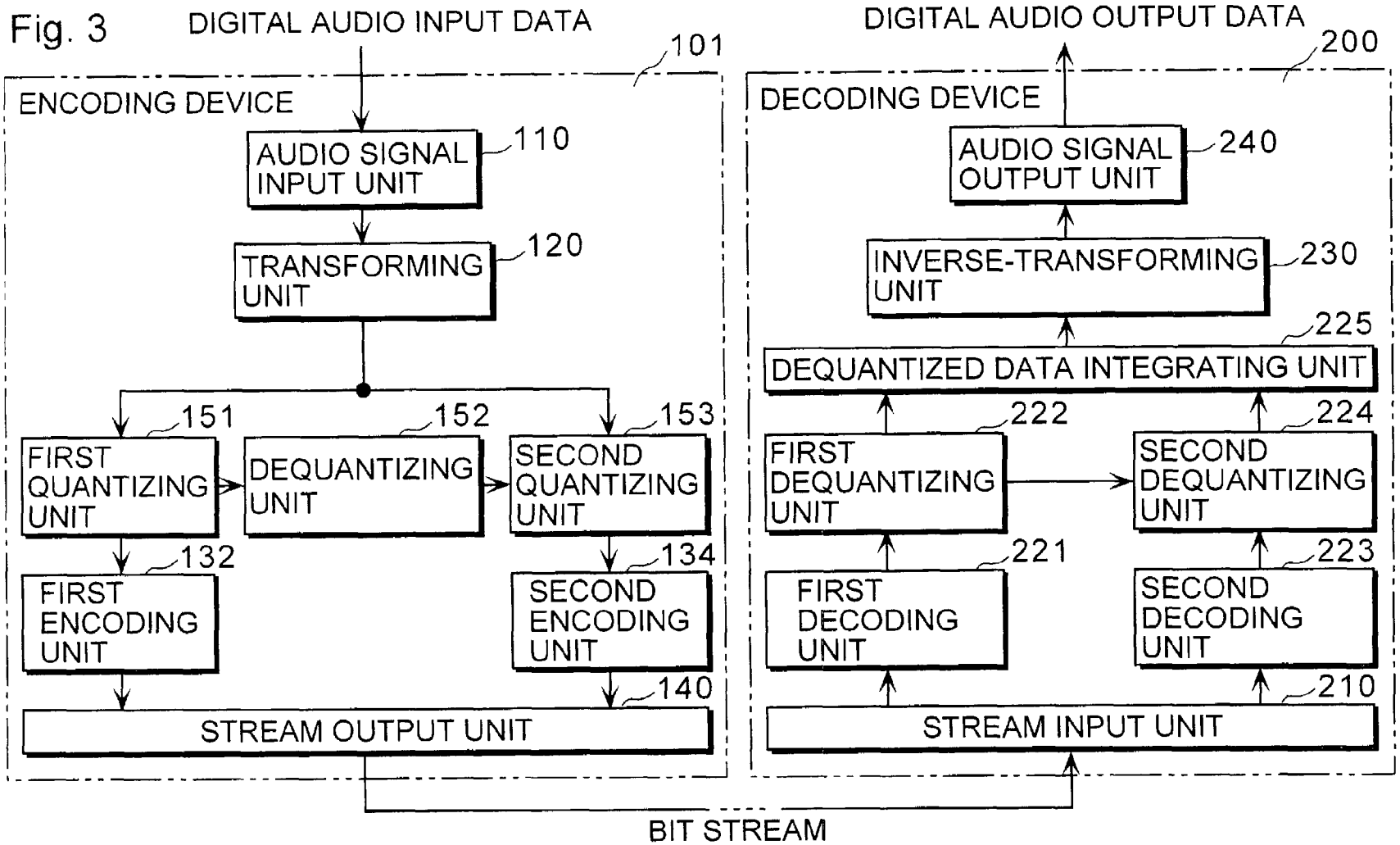
FIG. 3 is a block diagram showing another configuration of the encoding device and the decoding device according to the present embodiment.

FIG. 3 is a block diagram showing another configuration of the encoding device 101 and the decoding device 200 according to the present embodiment. Since the components that are the same as those of FIG. 2 have been already described, they are assigned with the same codes as those in FIG. 2 and the explanation of such components will be omitted.

The encoding device 101 is different from the encoding device 100 in that the former additionally includes a dequantizing unit 152. In this encoding device 101, the first quantizing unit 151 quantizes all the spectral data composed of 1,024 samples outputted from the transforming unit 120, and outputs the quantized results to the dequantizing unit 152 and also outputs the quantized results of 512 samples in the lower frequency band to the first encoding unit 132.

The dequantizing unit 152 dequantizes the values quantized by the first quantizing unit 151, and outputs the dequantized results, that is, the spectral data, to the second quantizing unit 153.

The second quantizing unit 153 does not receive the spectral data from the transforming unit 120 but receives the spectral data that is the result of dequantization by the dequantizing unit 152, and generates the sub information for the higher frequency band based on the received spectral data.

In the present embodiment, the second quantizing unit 153 does not receive the spectral data from the transforming unit 120 but generates the sub information for the higher frequency band based on the spectral data received from the dequantizing unit 152, but the present invention is not limited to this. The second quantizing unit 153 may receive the spectral data from the transforming unit 120 for a certain part and the spectral data from the dequantizing unit 152 for another part.

Figure 4A:
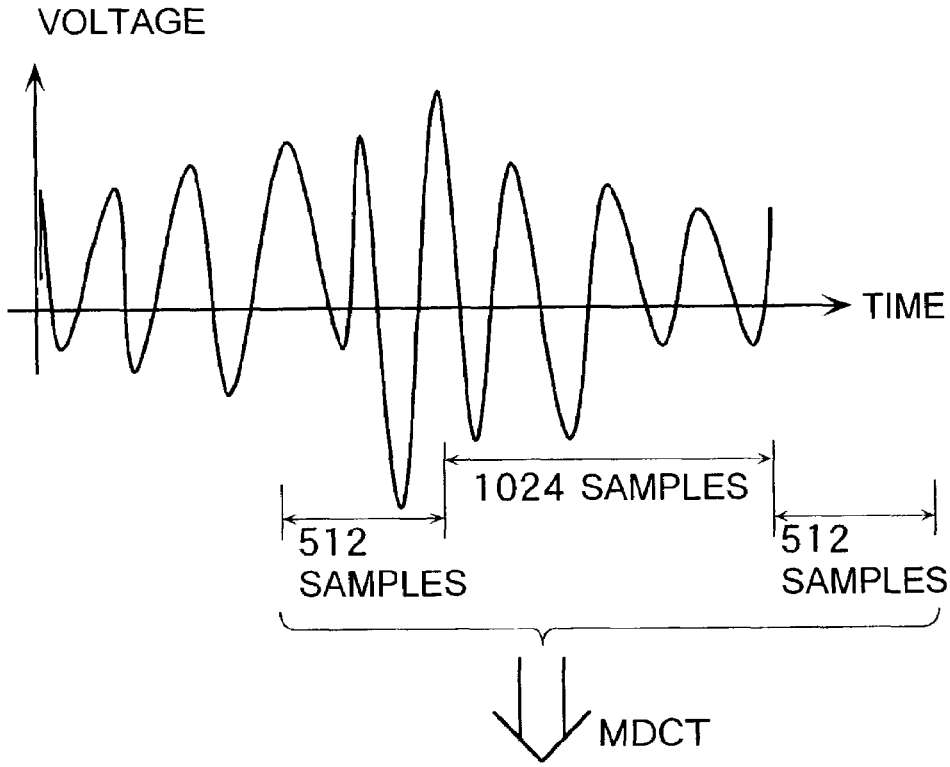
FIG. 4A and FIG. 4B are diagrams showing a state change of audio data which is processed in the encoding device shown in FIG. 2.
Figure 4B:
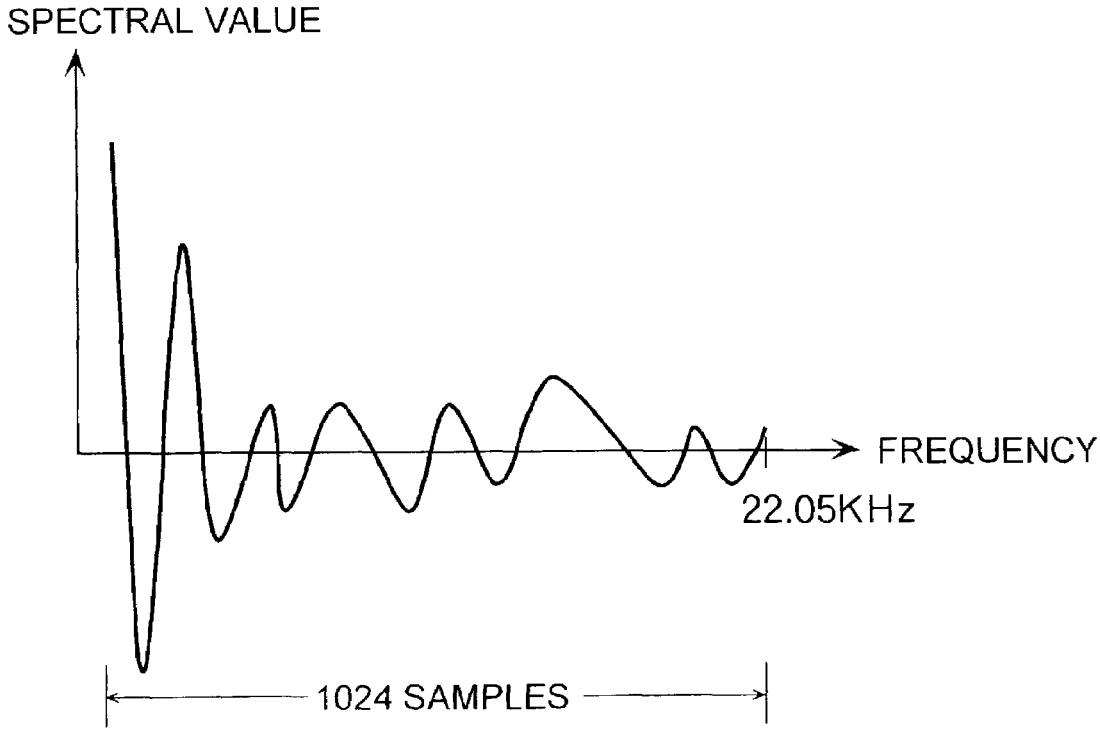

FIG. 4A and FIG. 4B are diagrams showing a state change of audio data which is processed in the encoding device 100 shown in FIG. 2. FIG. 4A shows an example of a waveform of the 1,024 sample data in the time domain divided by the audio signal input unit 110 shown in FIG. 2. FIG. 4B shows an example of the spectral data in the frequency domain generated after the sample data in the time domain is performed MDCT by the transforming unit 120 shown in FIG. 2. Note that the sample data and the spectral data are shown as analog waveforms in FIGS. 4A and 4B although they are digital signals in reality. The same is true in the following diagrams showing waveforms.

The audio signal input unit 110 receives digital audio signals sampled at a sampling frequency of 44.1 kHz. The audio signal input unit 110 divides this digital audio signal into every contiguous 1,024 samples with two sets of 512 samples obtained before and after the 1,024 samples being overlapped, and outputs them to the transforming unit 120. The transforming unit 120 performs MDCT on the 2,048 sample data in total. The waveform of the spectral data generated according to MDCT is symmetrically arranged, and therefore only a half of the spectral data corresponding to 1,024 samples is encoded, as shown in FIG. 4B.

In FIG. 4B, the vertical axis indicates the values of frequency spectral data, that is, the amount (size) of the frequency components of the audio signals represented in voltage values of the 1,024 samples in FIG. 4A, at 1,024 points corresponding to the number of samples. Since the sampling frequency of the digital audio signals inputted into the encoding device 100 is 44.1 kHz, the reproduction bandwidth of the spectral data is 22.05 kHz. Furthermore, since the spectra generated according to MDCT may have negative values as shown in FIG. 4B, the positive and negative signs of the spectra generated according to MDCT also need to be encoded when encoding the spectra. In the following explanation, the information indicating the positive and negative signs of the spectral data is called "sign information".

Figure 5A:
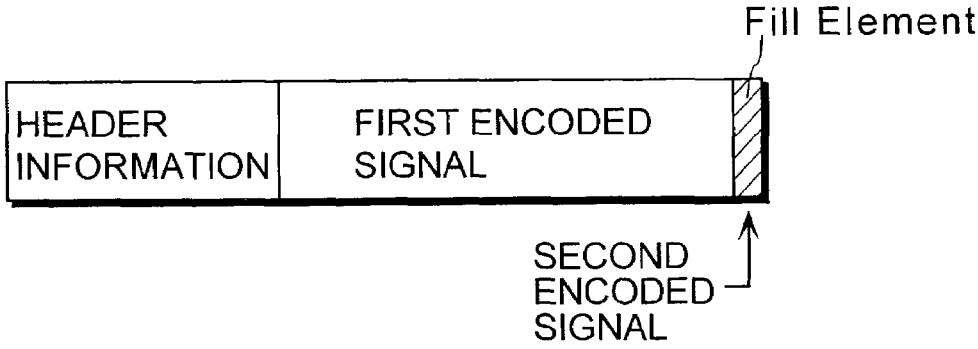
FIGS. 5A, 5B and 5C are diagrams showing areas in bit streams in which sub information are stored by the stream output unit shown in FIG.2.
Figure 5B:
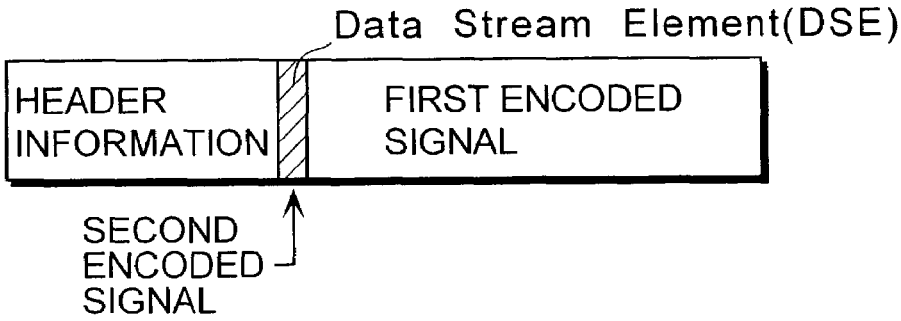
Figure 5C:
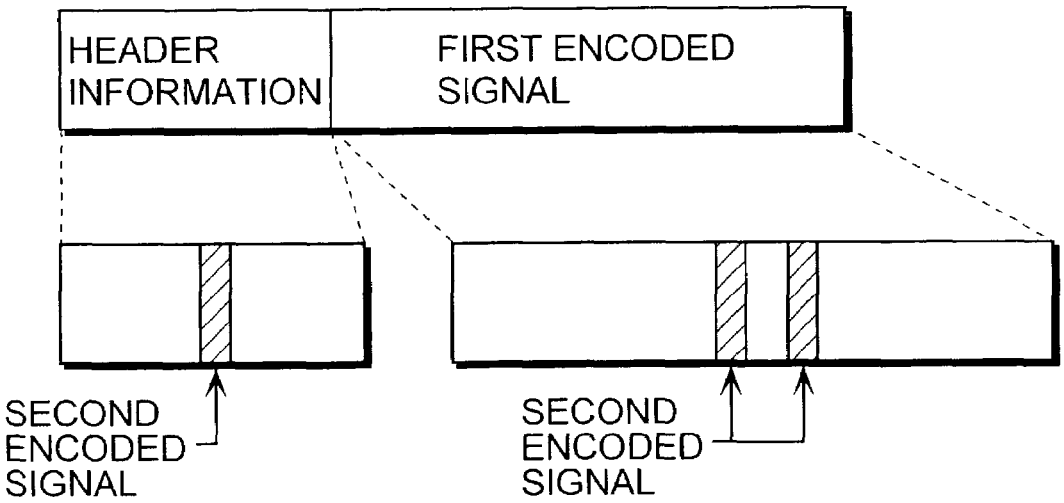

FIGS. 5A~5C are diagrams showing areas in bit streams in which the sub information are stored by the stream output unit 140 shown in FIG.2. In these figures, the sub information indicating the spectra in the higher frequency band is encoded, and then stored as a second encoded signal in an area where it is not recognized as an audio encoded signal in the bit stream.

In FIG. 5A, a shaded part is an area called Fill Element, which is filled with "0" in order to make uniform a data length of bit stream. Even if the sub information indicating the spectrum in the higher frequency band, that is, the second encoded signal, is stored in this area, it is not recognized as an encoded signal to be decoded and ignored in the conventional decoding device 400.

In FIG. 5B, a shaded part is an area called Data Stream Element (DSE), for instance. This area is provided in anticipation of future extension for MPEG-2 AAC, and only its physical structure is defined in MPEG-2 AAC. As in Fill Element, even if the sub information indicating the spectra in the higher frequency band is stored in this area, the conventional decoding device 400 ignores it, or does not perform any operations in response to the read information since operation that should be performed by the conventional decoding device 400 is not defined.

In the above explanation, the second encoded signal is stored in an area, contained in an MPEG-2 AAC bit stream, that is ignored by the conventional decoding device 400. However, the second encoded signal may be integrated into a predetermined area within the header information, or into a predetermined area of the first encoded signal, or into both the header and the first encoded signal. It is not necessary to secure contiguous areas in the header and the first encoded signal for storing the second encoded signal in the bit stream. For instance, the second encoded signal may be integrated discretely between the header information and the first encoded information, as shown in FIG. 5C.

Figure 6A:
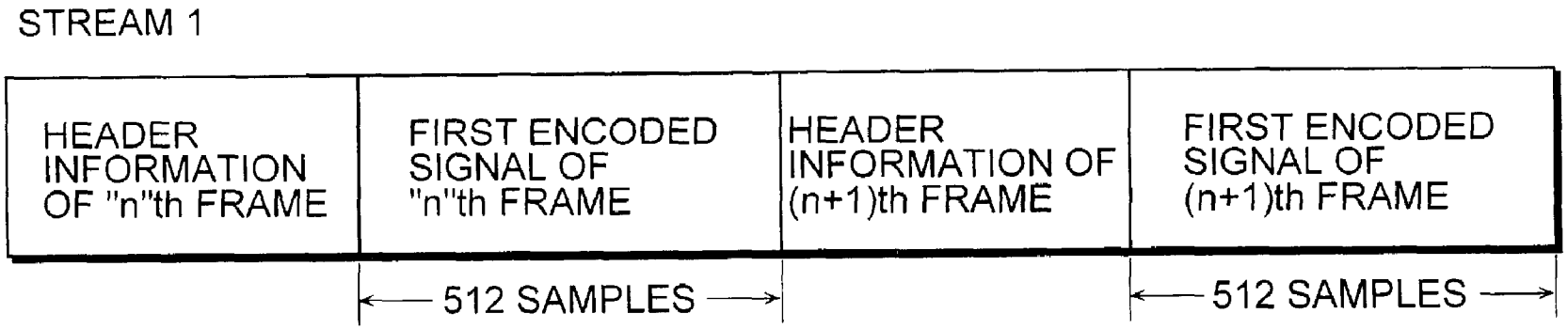
FIGS. 6A and 6B are diagrams showing other examples of areas of bit streams in which the sub information is stored by the stream output unit shown in FIG. 2.
Figure 6B:
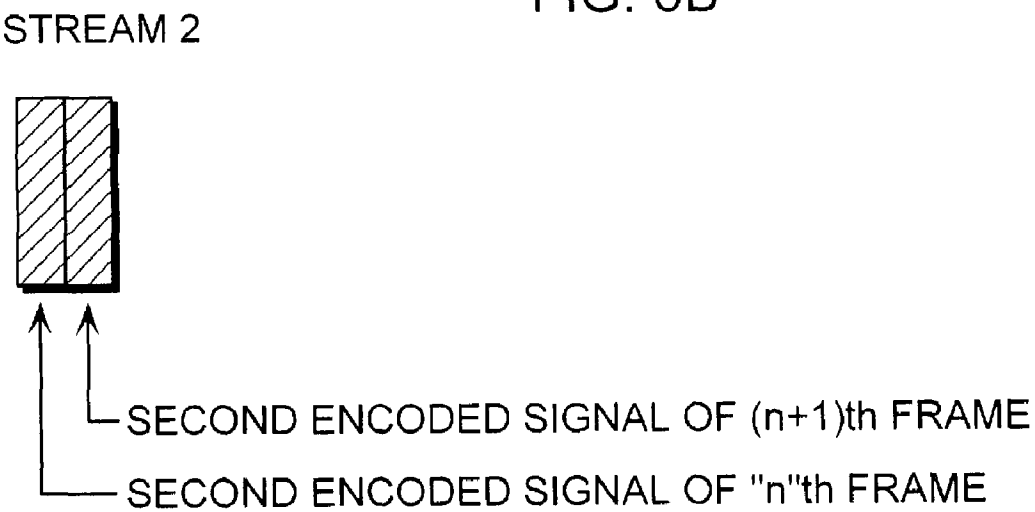

FIG. 6A and FIG. 6B are diagrams showing other examples of areas of bit streams in which the sub information is stored by the stream output unit 140 shown in FIG. 2. FIG. 6A shows a stream 1 in which only the first encoded signal is stored contiguously in each frame. FIG. 6B shows a stream 2 in which only the second encoded signal, that is, the encoded sub information, is stored contiguously in each frame corresponding to the stream 1.

The stream output unit 140 may store the second encoded signal in the stream 2 which is completely different from the stream 1 in which the first encoded signal is stored. The stream 1 and the stream 2 are bit streams which are transmitted via different channels, for instance.

As mentioned above, since the lower frequency band indicating the basic information of the input audio signal is transmitted or stored in advance by transmitting the first and second encoded signals in completely different bit streams, there is an effect that the information for the higher frequency band can be added later if necessary.

The operations of the encoding device 100 and the decoding device 200 as mentioned above will be explained with reference to the flowcharts of FIGS. 7, 8, 10, 12, 14, 16, 18, and 20~22.

Figure 7:
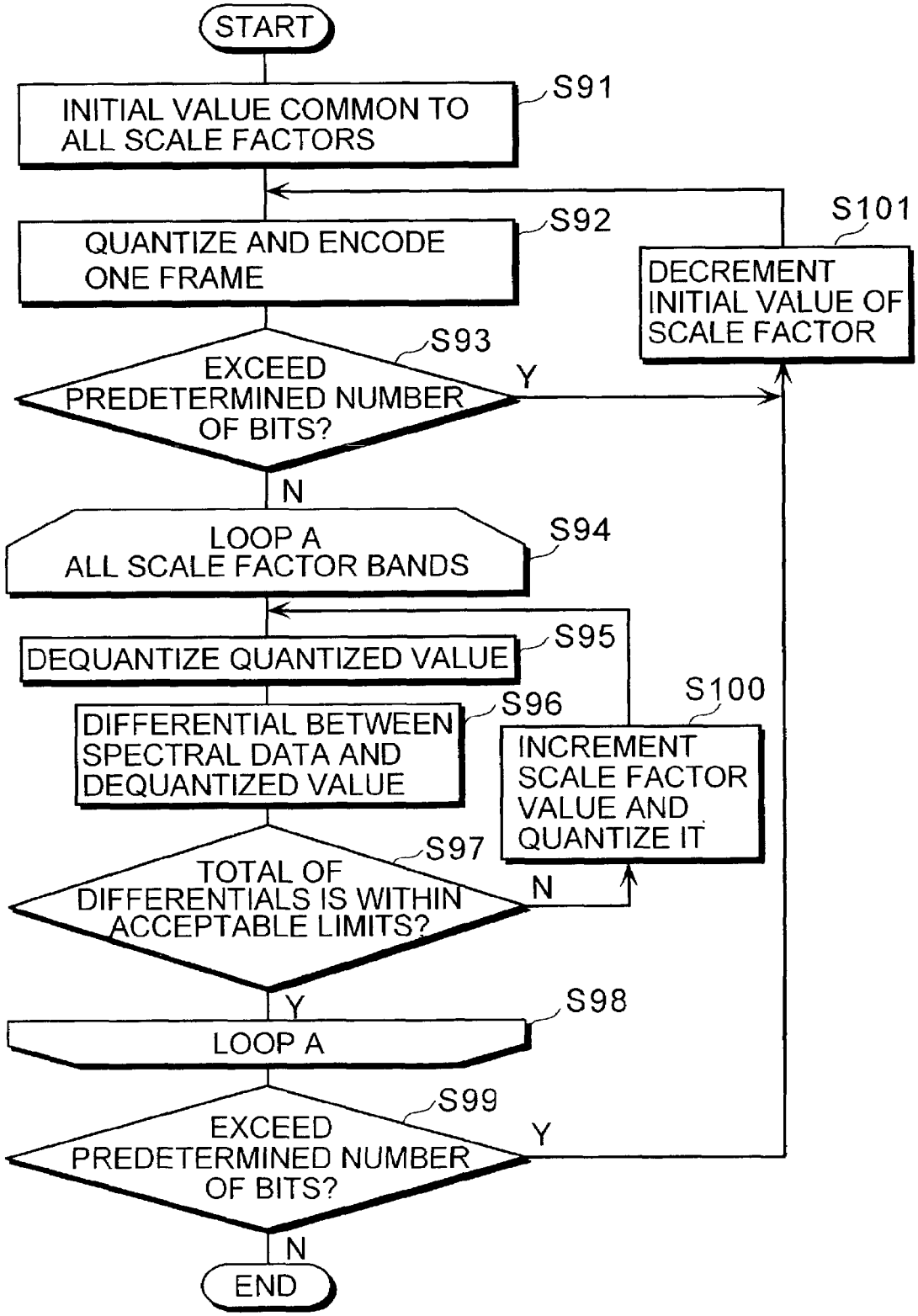
FIG. 7 is a flowchart showing an operation in a scale factor determination processing performed by the first quantizing unit shown in FIG. 2.

FIG. 7 is a flowchart showing an operation in a scale factor determination processing performed by the first quantizing unit shown in FIG. 2. The first quantizing unit 131 first determines a scale factor common to each scale factor band as an initial value of the scale factor (S91), quantizes all the spectral data in the lower frequency band which are to be transmitted as audio data of one frame using the determined scale factor, calculates the differentials between the contiguous two scale factors, and Huffman-codes the differentials, the first scale factor and the quantized values of the spectral data (S92). Note that quantizing and encoding here are performed for only counting the number of bits. Therefore, data only is quantized and encoded, and the information such as a header is not added, in order to simplify the processing. Next, the first quantizing unit 131 judges whether the number of bits of the Huffman-coded data exceeds a predetermined number of bits or not (S93), and if it exceeds, decrements the initial value of the scale factor (S101). Then, the first quantizing unit 131 quantizes and Huffman-codes the same spectral data in the lower frequency band again using the decremented scale factor value (S92), judges whether the number of bits of the Huffman-coded data in the lower frequency band for one frame exceeds the predetermined number of bits or not (S93), and repeats this processing until it becomes the predetermined number of bits or less.

When the number of bits of the encoded data in the lower frequency band does not exceed the predetermined one, the first quantizing unit 131 repeats the following processing for each scale factor band, and determines the scale factor of each scale factor band (S94).

First, it dequantizes each quantized value in the scale factor band (S95), calculates the differentials of the absolute values between the dequantized values and the corresponding original spectral data values, and sums them up (S96). Further, it judges whether the total of the calculated differentials is a value within acceptable limits or not (S97), and if it is within the acceptable limits, repeats the above processing for the next scale factor band (S94~S98). On the other hand, it exceeds the acceptable limits, the first quantizing unit 131 increments the scale factor value and quantizies the spectral data of that scale factor band (S100), and dequantizes the quantized value (S95) and sums up the differentials of the absolute values of the dequantized values and the corresponding spectral data values (S96). Furthermore, the first quantizing unit 131 judges whether the total of the differentials is within acceptable limits or not (S97), and if it exceeds the limits, increments the scale factor until it becomes a value within the limits (S100), and repeats the above processing (S95~S97 and S100).

When the first quantizing unit 131 determines, for all the scale factor bands, the scale factors by which the total of the differentials of the absolute values between the dequantized quantized values in the scale factors and the corresponding original spectral data values is within acceptable limits (S98), it quantizes the spectral data in the lower frequency band for one frame again using the determined scale factors, Huffman-codes the differentials of the respective scale factors, the first scale factor and the quantized values of that spectral data, and judges whether the number of bits of the encoded data in the lower frequency band exceeds a predetermined number of bits or not (S99). If the number of bits of the encoded data in the lower frequency band exceeds the predetermined one, the first quantizing unit 131 decrements the initial value of the scale factor until it becomes the predetermined number or less (S101), and then repeats the processing of determining the scale factor in each scale factor band (S94~S98). If the number of bits of the encoded data in the lower frequency band does not exceed the predetermined one (S99), it determines the value of each scale factor at that time to be the scale factor of each scale factor band.

Note that whether the total of the differentials of the absolute values between the dequantized quantized values in the scale factor band and the original spectral data values is within acceptable limits or not is judged based on the data of psychoacoustic model and so on.

Also, in the above case, a relatively large value is set as an initial value of the scale factor, and when the number of bits of the Huffman-coded data in the lower frequency band exceeds a predetermined number of bits, the initial value of the scale factor is decremented so as to determine the scale factor, but the scale factor need not always be determined in this manner. For example, a lower value is set as an initial value of the scale factor in advance, and the initial value may be gradually incremented. And the scale factor of each scale factor band may be determined using the initial value of the scale factor that has been set just before the total number of bits of the encoded data in the lower frequency band first exceeds a predetermined number of bits.

Furthermore, in the present embodiment, the scale factor of each scale factor band is determined so that the total number of bits of the encoded data in the lower frequency band for one frame does not exceed the predetermined number, but the scale factor need not always be determined in this manner. For example, the scale factor may be determined so that each quantized value in the scale factor band does not exceed the predetermined number of bits in each scale factor band. The operation of the first quantizing unit 131 in this processing will be explained below with reference to FIG. 8.

Figure 8:
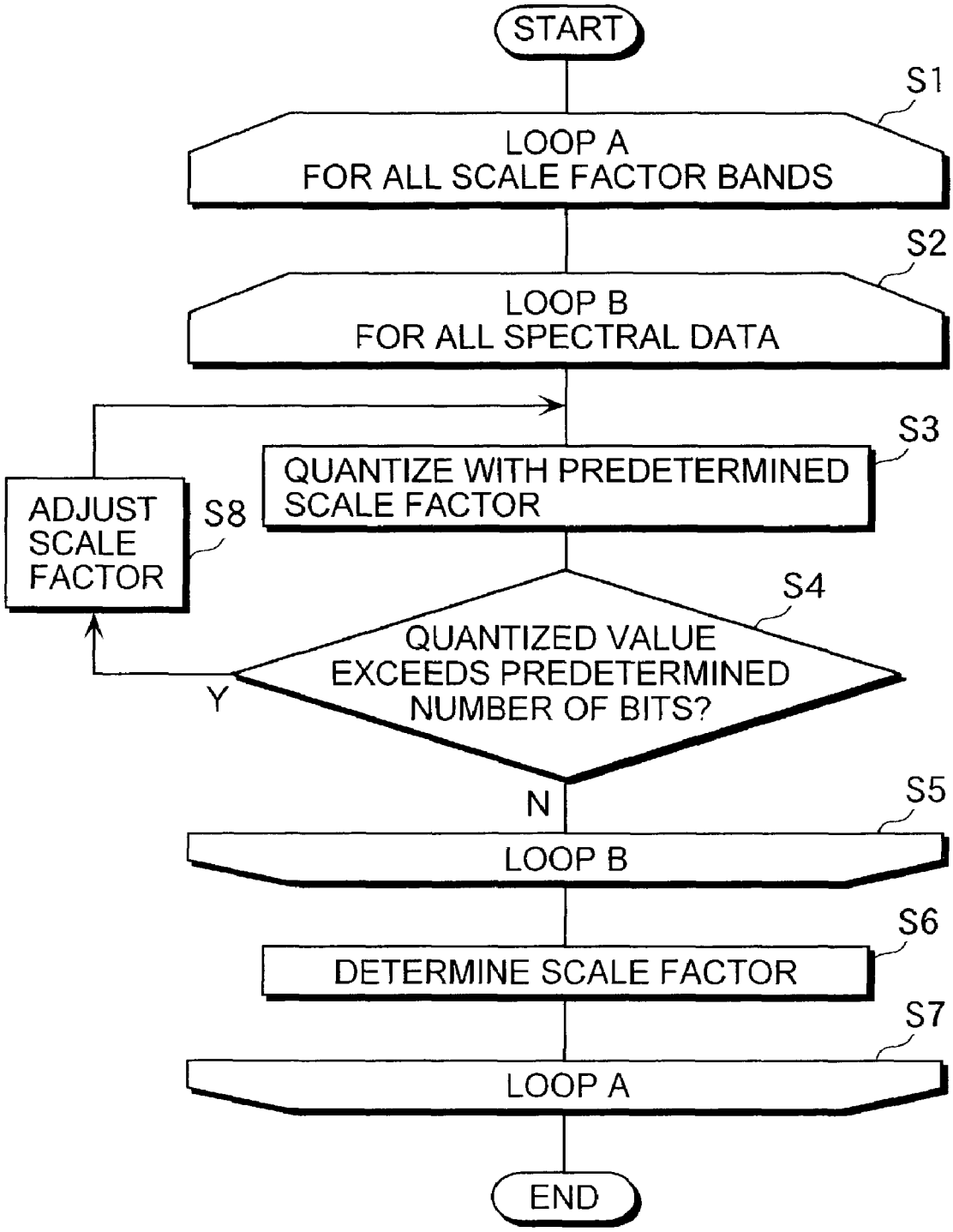
FIG. 8 is a flowchart showing another operation in a scale factor determination processing by the first quantizing unit shown in FIG. 2.

FIG. 8 is a flowchart showing an operation in another scale factor determination processing by the first quantizing unit 131 shown in FIG. 2. The first quantizing unit 131 calculates the scale factors for all the scale factor bands in the lower frequency band to be encoded according to the following procedure (S1). Also, the first quantizing unit 131 calculates the scale factors for all the spectral data in each scale factor band according to the following procedure (S2).

First, the first quantizing unit 131 quantizes the spectral data with a predetermined scale factor value based on a formula (S3), and judges whether the quantized value exceeds a predetermined number of bits given for indicating the quantized value, 4 bits, for instance (S4).

When the quantized value exceeds 4 bits as a result of the judgment, the first quantizing unit adjusts the scale factor value (S8), and quantizes the same spectral data with the adjusted scale factor value (S3). The first quantizing unit 131 judges whether the obtained quantized value exceeds 4 bits or not (S4), and repeats adjustment of the scale factor (S8) and quantization of the adjusted scale factor (S3) until the quantized value of the spectral data becomes 4 bits or less.

When the quantized value is 4 bits or less as a result of the judgment, it quantizes the next spectral data with the predetermined scale factor value (S3).

When the quantized values of all the spectral data in one scale factor band become 4 bits or less (S5), the first quantizing unit 131 determines the scale factor value at that time to be a scale factor for the scale factor band (S6).

After determining the scale factors of all the scale factor bands (S7), the first quantizing unit 131 ends the processing.

According to the above processing, the respective scale factors are determined for all the scale factor bands in the lower frequency band to be encoded. The first quantizing unit 131 quantizes the spectral data in the lower frequency band using the scale factor determined as mentioned above, and outputs the quantized value of 4 bits that is the quantized result and the scale factor of 8 bits to the first encoding unit 132.

Figure 9:
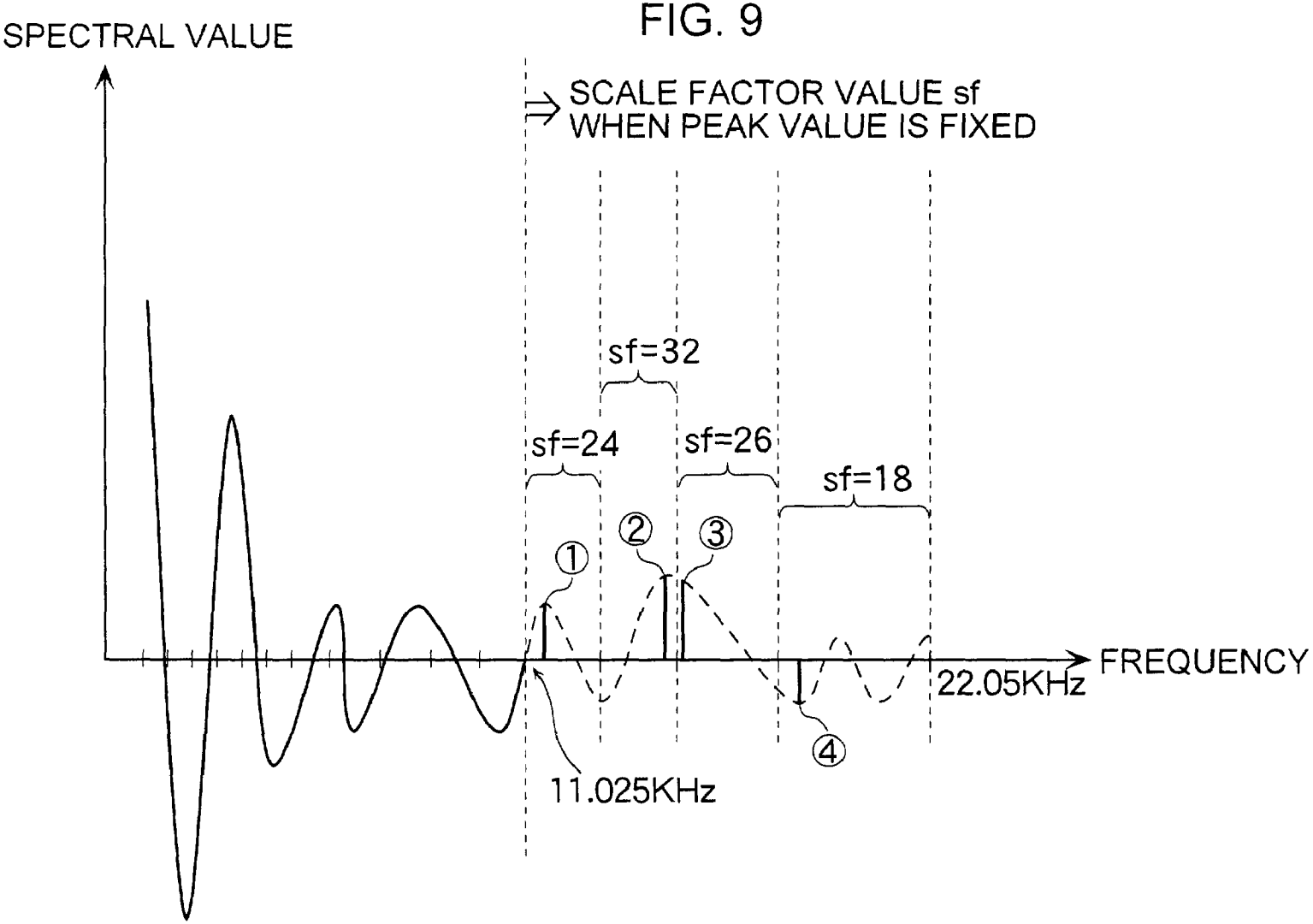
FIG. 9 shows a spectral waveform showing a concrete example of the sub information (scale factor) which is generated by the second quantizing unit shown in FIG. 2.

FIG. 9 shows a spectral waveform showing a concrete example of the sub information (scale factor) which is generated by the second quantizing unit 133 shown in FIG. 2. In FIG. 9, delimiters indicated on the frequency axis in the lower frequency band show those of the scale factor bands determined in the present embodiment. Also, delimiters indicated by broken lines on the frequency axis in the higher frequency band show those of the scale factor bands in the higher frequency band determined in the present embodiment. The same is true on the following waveforms.

Among the spectral data outputted from the transforming unit 120, the reproduction bandwidth in the lower frequency band of 11.025 kHz or less, indicated in a full line waveform in FIG. 9, is output to the first quantizing unit 131, and quantized as usual. On the other hand, the reproduction bandwidth in the higher frequency band over 11.025 kHz to 22.05 kHz, indicated in a broken line waveform in FIG. 9, is represented by the sub information (scale factor) calculated by the second quantizing unit 133. The calculation procedure of the sub information (scale factor) by the second quantizing unit 133 will be explained below according to the flowchart in FIG. 10, using a concrete example of FIG. 9.

Figure 10:
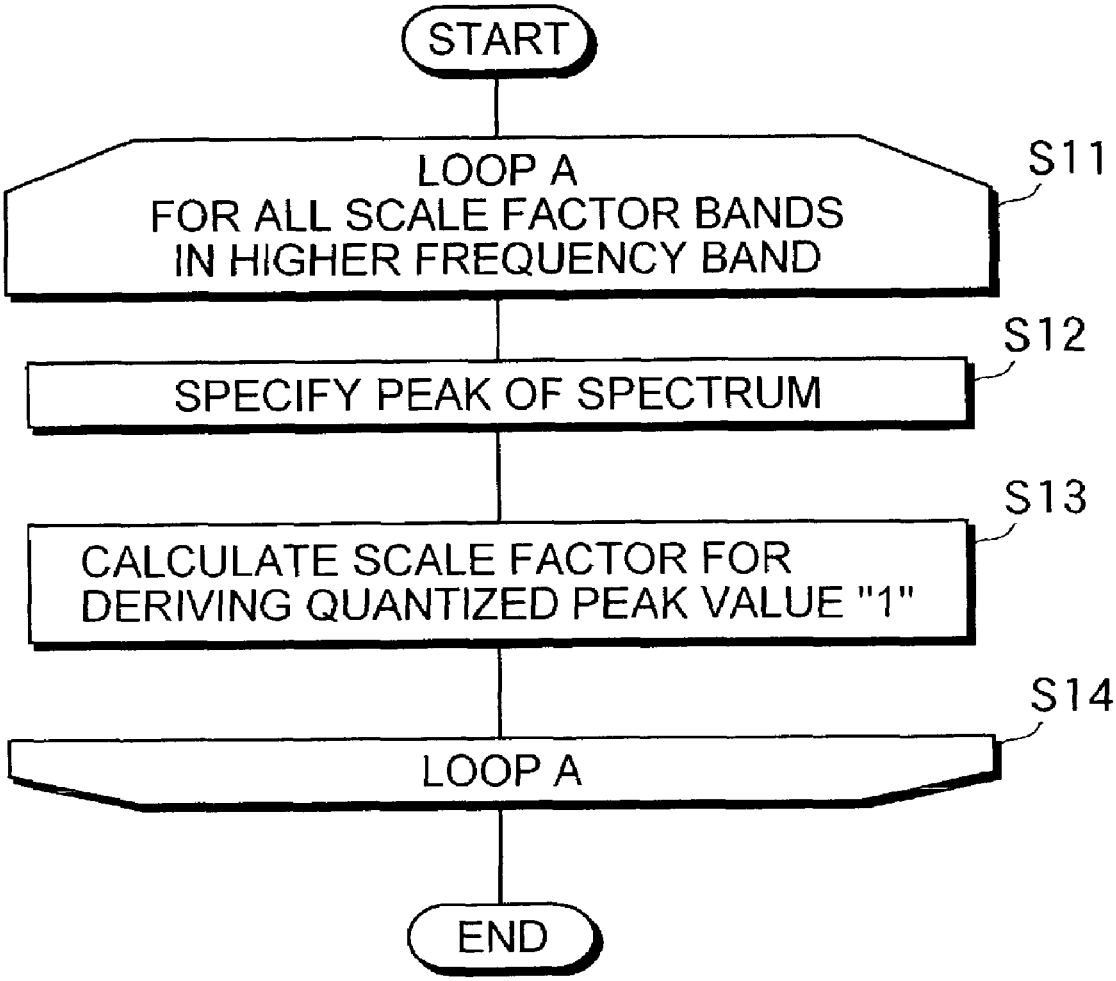
FIG. 10 is a flowchart showing an operation in a sub information (scale factor) calculation processing performed by the second quantizing unit shown in FIG. 2.

FIG. 10 is a flowchart showing an operation in the sub information (scale factor) calculation processing performed by the second quantizing unit 133 shown in FIG. 2.

The second quantizing unit 133 calculates the optimum scale factor for deriving the quantized value "1" of the absolute maximum spectral data in each scale factor band in every scale factor band in the higher frequency band having the reproduction bandwidth over 11.025 kHz up to 22.05 kHz, according to the following procedure (S11).

The second quantizing unit 133 specifies the absolute maximum spectral data (peak) in the first scale factor band in the higher frequency band having the reproduction bandwidth over 11.025 kHz (S12). In the example of FIG. 9, ① (D indicates the peak specified in the first scale factor band, and the value of the peak is "256".

According to the same procedure as shown in the flowchart of FIG. 8, the second quantizing unit 133 calculates the scale factor value "sf" for deriving the quantized value "1" obtained from a quantization formula by assigning the peak value "256" and the initial value of the scale factor in the formula (S13). In this case, sf=24 is calculated ("sf" is the scale factor value for deriving the quantized value "1" of the peak value "256"), for instance.

When calculating the scale factor value sf=24 for deriving the quantized peak value "1" for the first scale factor band (S14), the second quantizing unit 133 specifies the peak of the spectral data of the next scale factor band (S12), and if the specified peak position is and the value is "312", it calculates the scale factor value for deriving the quantized value "1" of the peak value "312", sf =32, for instance (S13).

In the same manner, the second quantizing unit 133 calculates the scale factor value of the third scale factor band in the higher frequency band for deriving the quantized value "1" of the peak ③ value "288", sf=26, and that of the fourth scale factor band for deriving the quantized value "1" of the peak G) value "203", sf=18, for instance, respectively.

When calculating the scale factor for every scale factor band in the higher frequency band for deriving the quantized value "1" of the peak value in this way (S14), the second quantizing unit 133 outputs the scale factor of each scale factor band obtained by the calculation to the second encoding unit 134 as the sub information for the higher frequency band, and ends the processing.

The sub information (scale factor) is generated by the second quantizing unit 133, as mentioned above. If this sub information (each scale factor) value represented in 512 samples of spectral data are represented in numerical values from 0 to 255 for each scale factor band (4 bands in this case) in the higher frequency band, it can be represented in 8 bits. Also, if the differentials between the respective scale factors are Huffman-coded, it is likely that the data amount can be further reduced. On the other hand, if the 512 samples of spectral data in the higher frequency band are quantized and Huffman-coded in the conventional method as done for the lower frequency band, it is predicted that the data amount becomes 150 bits at least. Therefore, this sub information just indicates one scale factor for each scale factor band in the higher frequency band, but it is evident that the data amount is substantially reduced compared with the quantization in the higher frequency band in the conventional method.

Also, this scale factor indicates a value approximately proportional to the peak value (absolute value) in each scale factor band, so it can be said that the 512 samples of spectral data in the higher frequency band taking a fixed value or the spectral data obtained by multiplying a copy of a part or all of the spectral data in the lower frequency band by scale factors roughly reconstructs the spectral data obtained based on the input audio signals. Also, the spectral data can be reconstructed more accurately by multiplying each spectral data in the band by a ratio between the absolute maximum value of the spectral data copied in the band and the value obtained by dequantizing the quantized value "1" using the scale factor value corresponding to that band, as a coefficient, for every scale factor band. Furthermore, the difference of the waveform in the higher frequency band is not so clearly identified visually as that in the lower frequency band, so the sub information obtained as above is enough as information indicating the waveform in the higher frequency band.

In the present embodiment, the scale factor is calculated so that the quantized value of the spectral data in each scale factor band in the higher frequency band becomes "1", but it does not always need to be "1" and may be another value.

Also, in the present embodiment, only a scale factor is encoded as sub information, but the present invention is not limited to that, and a quantized value, position information of a characteristic spectrum, sign information indicating a negative or positive sign of the spectrum, a noise generation method, and others may be encoded all together. Or two or more of them may be encoded in combination. In this case, it is particularly effective if a combination of a coefficient indicating a ratio of amplitude, a position of the absolute maximum spectral data and so on in the sub information is encoded.

Figure 11:
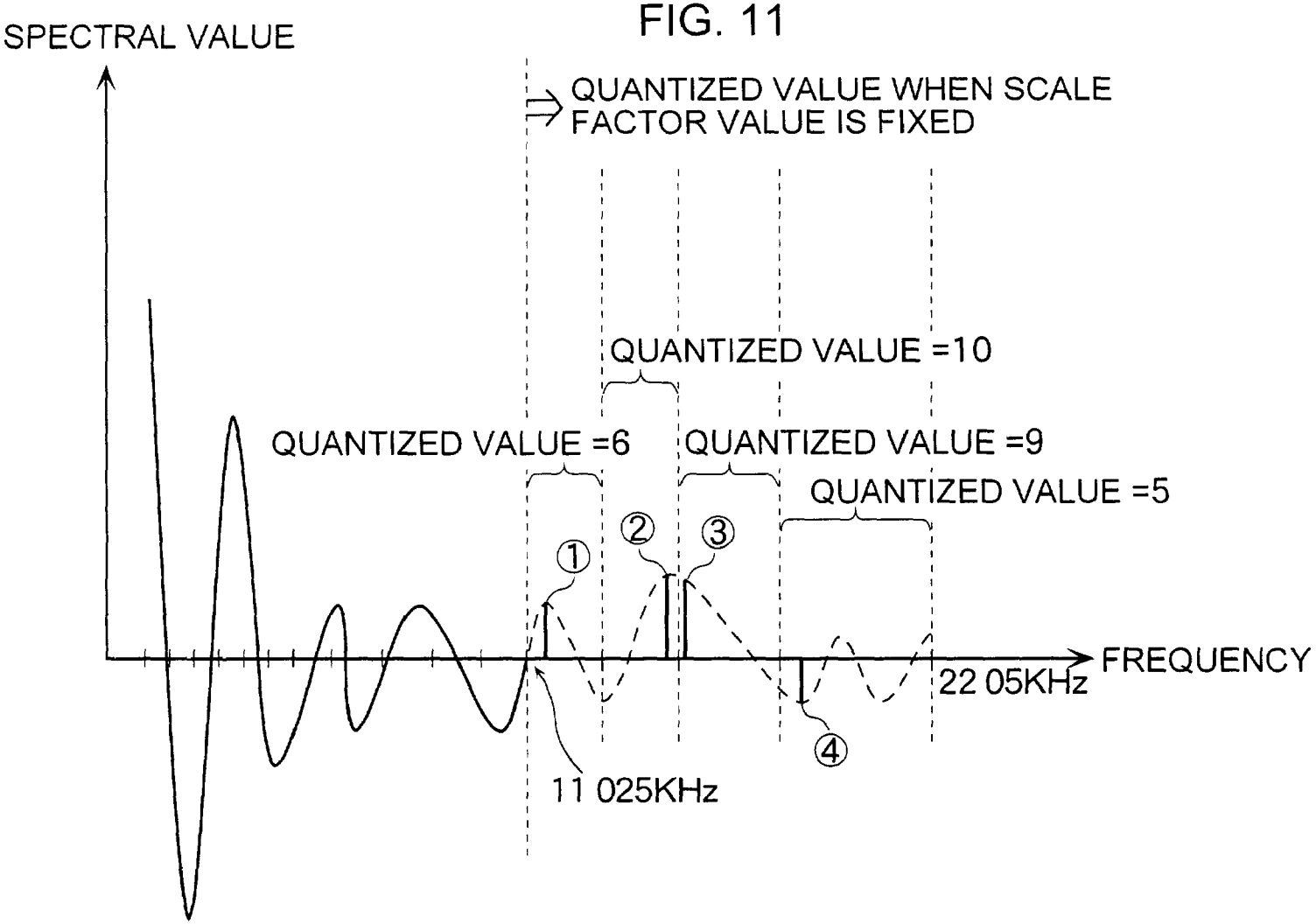
FIG. 11 shows a spectral waveform showing a concrete example of the sub information (quantized value) which is generated by the second quantizing unit shown in FIG. 2.
Figure 12:
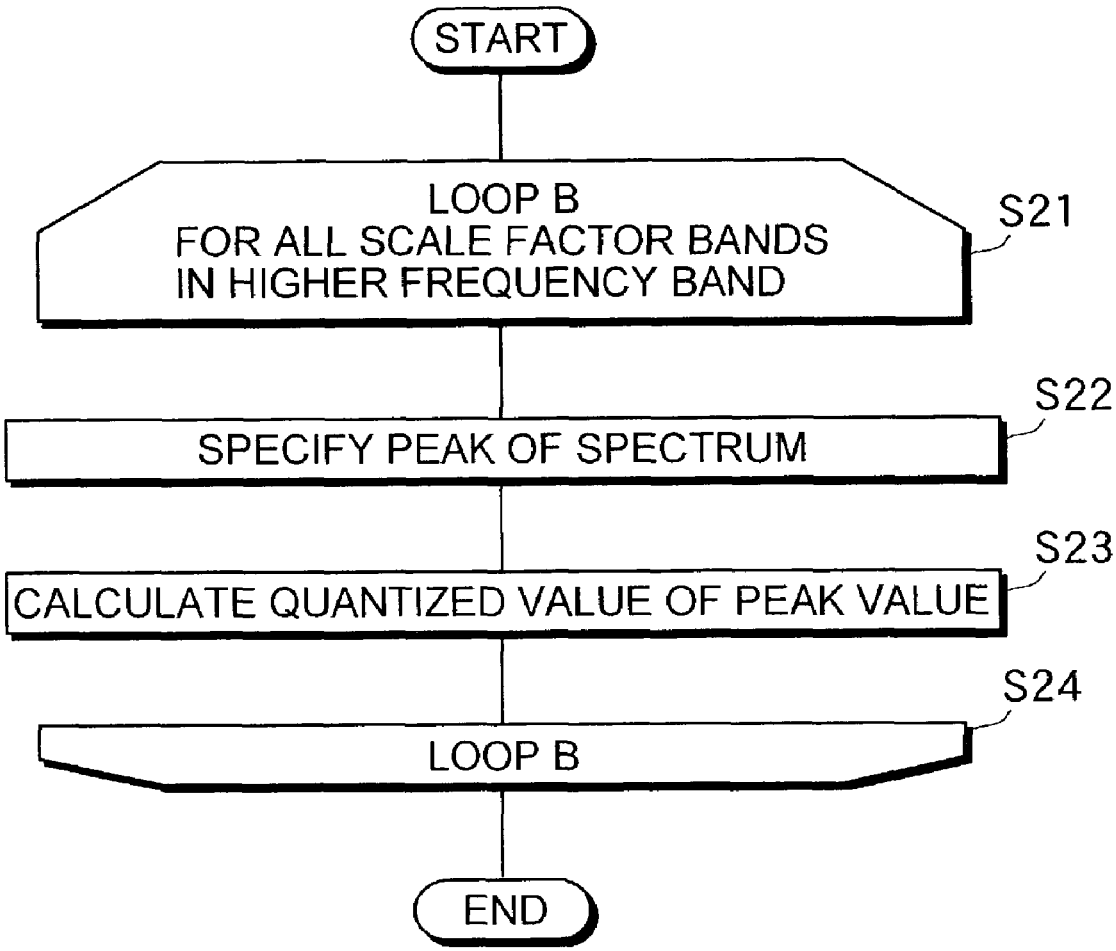
FIG. 12 is a flowchart showing an operation in a sub information (quantized value) calculation processing performed by the second quantizing unit shown in FIG. 2.

FIG. 11 shows a spectral waveform showing a concrete example of the sub information (quantized value) which is generated by the second quantizing unit 133 shown in FIG. 2. FIG. 12 is a flowchart showing an operation in the sub information (quantized value) calculation processing performed by the second quantizing unit 133 shown in FIG. 2.

The second quantizing unit 133 predetermines a scale factor value, "18", for instance, common to all the scale factor bands in the higher frequency band having the reproduction bandwidth over 11.025 kHz up to 22.05 kHz, and using this scale factor value "18", calculates the quantized value of the absolute maximum spectral data (peak) in each scale factor band (S21).

The second quantizing unit 133 specifies the absolute maximum spectral data (peak) in the first scale factor band in the higher frequency band having the reproduction bandwidth over 11.025 kHz (S22). In the example of FIG. 11, ① indicates the peak specified in the first scale factor band and the peak value at that time is "256".

The second quantizing unit 133 calculates the quantized value by applying the predetermined common scale factor value "18" and the peak value "256" to a formula for calculating the quantized value (S23). For example, if the peak value "256" is quantized with the scale factor value "18", the quantized value "6" is calculated.

When the quantized value "6" of the peak value "256" is calculated for the first scale factor band (S24), the second quantizing unit 133 specifies the peak of the spectral data in the next scale factor band (S22). If the specified peak position is ③ and the peak value is "312", for instance, it calculates the quantized value "10", for instance, of the peak value "312" with the scale factor value "18" (S23).

In the same manner, the second quantizing unit 133 calculates the quantized value "9" of the peak ③ value "288" with the scale factor value "18" for the third scale factor band in the higher frequency band, and calculates the quantized value "5" of the peak ④ value "203" with the scale factor value "18" for the fourth scale factor band.

When the quantized values of the peak values with the fixed scale factor "18" for all the scale factor bands in the higher frequency band are calculated (S24), the second quantizing unit 133 outputs the quantized value of each scale factor band obtained by the calculation to the second encoding unit 134 as sub information for the higher frequency band, and ends the processing.

As described above, the second quantizing unit 133 generates the sub information (quantized value). This sub information represents the 4 scale factor bands in the higher frequency band represented in 512 samples of spectral data, in quantized values of 4 bits, respectively, while the above-mentioned sub information (scale factor) represents the 4 scale factor bands in the higher frequency band, in spectral data of 8 bits, respectively. Therefore, the data amount in the higher frequency band is much more reduced in the case of the quantized value. Also, this quantized value roughly represents the amplitude of the peak value (absolute value) of each scale factor band, and it can be said that the 512 samples of spectral data in the higher frequency band taking a fixed value or the spectral data obtained by just multiplying a copy of a part or all of the spectral data in the lower frequency band by the quantized value roughly reconstructs the spectral data obtained based on the input audio signals. Also, the spectral data can be reconstructed more accurately by multiplying each spectral data in the band by a ratio between the absolute maximum value of the spectral data copied in the band and the value obtained by dequantizing the quantized value corresponding to that band, as a coefficient, for every scale factor band.

In the present embodiment, the scale factor value corresponding to the quantized value to be transmitted as the second encoded information is predetermined, but the optimum scale factor value may be calculated and transmitted with being added to the second encoded information. For example, if a scale factor for deriving the maximum value "7" of the quantized value is selected, the number of bits indicating the quantized value is only 3, so the information amount required for transmitting the quantized value is much more reduced.

In the present embodiment, only the quantized value, or only the quantized value and the scale factor are encoded as the sub information, but the present invention is not limited to this, and the scale factor, position information of a characteristic spectrum, sign information of the spectral data, a noise generation method, and others may be encoded. Or a combination of two or more of them may be encoded.

Figure 13:
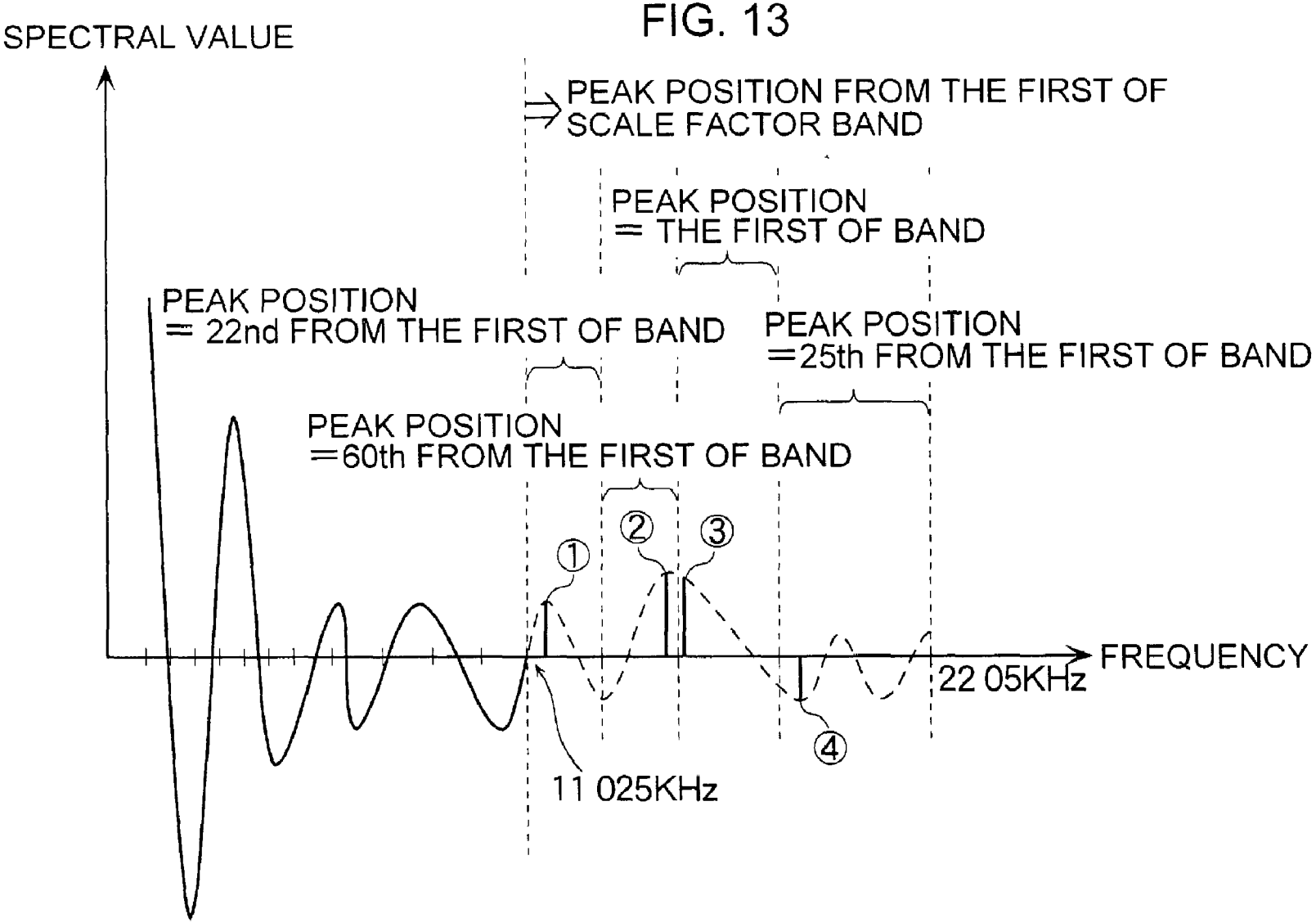
FIG. 13 shows a spectral waveform showing a concrete example of the sub information (position information) which is generated by the second quantizing unit shown in FIG.2.
Figure 14:
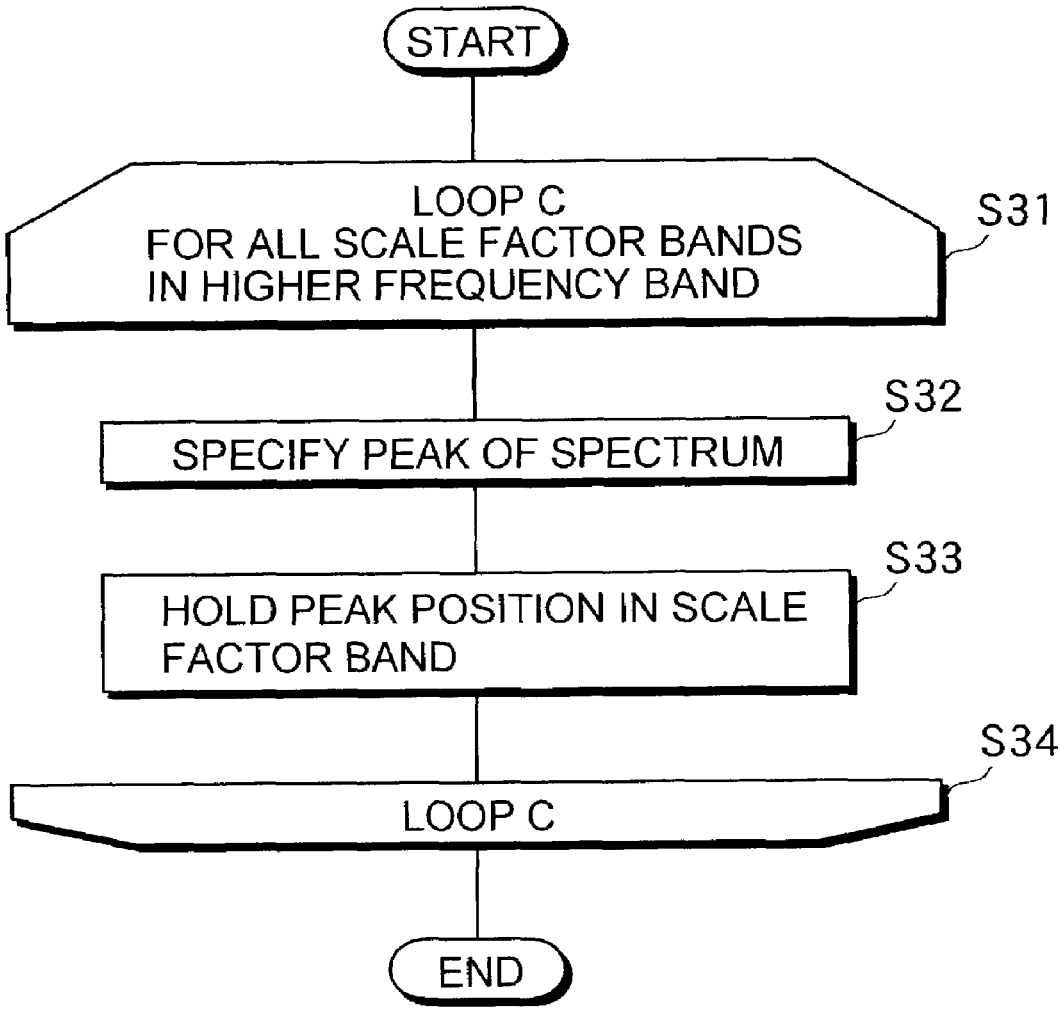
FIG. 14 is a flowchart showing an operation in a sub information (position information) calculation processing performed by the second quantizing unit shown in FIG. 2.

FIG. 13 shows a spectral waveform showing a concrete example of the sub information (position information) which is generated by the second quantizing unit 133 shown in FIG.2. FIG. 14 is a flowchart showing an operation in the sub information (position information) calculation processing performed by the second quantizing unit 133 shown in FIG. 2.

The second quantizing unit 133 specifies the position of the absolute maximum spectral data in every scale factor band in the higher frequency band having the reproduction bandwidth over 11.025 kHz up to 22.05 kHz according to the following procedure (S31).

The second quantizing unit 133 specifies the absolute maximum spectra data (peak) in the first scale factor band in the higher frequency band having the reproduction bandwidth over 11.025 kHz (S32). In the example of FIG. 13, ① indicates the peak specified in the first scale factor band and the 22nd spectral data from the first one of this scale factor band. The second quantizing unit 133 holds the specified peak position "the 22nd spectral data from the first one of the scale factor band" (S33).

When the peak position is specified and held for the first scale factor band (S34), the second quantizing unit 133 specifies the peak of the spectral data in the next scale factor band (S32). For example, the specified peak is positioned at ② and the 60th spectral data from the first one of the scale factor band. The second quantizing unit 133 holds the specified peak position "the 60th spectral data from the first one of the scale factor band" (S33).

In the same manner, the second quantizing unit 133 specifies and holds the peak ③ position in the third scale factor band in the higher frequency band "the first spectral data of the scale factor band", and specifies and holds the peak ④ position in the fourth scale factor band "the 25th spectral data from the first one of the scale factor band".

When the peak positions for all the scale factor bands in the higher frequency bands are specified and held (S34), the second quantizing unit 133 outputs the held peak positions of the scale factor bands to the second encoding unit 134 as the sub information for the higher frequency band, and ends the processing.

As described above, the second quantizing unit 133 generates the sub information (position information). This sub information (position information) represents the 4 scale factor bands in the higher frequency band represented in 512 samples of spectral data, in position information of 6 bits, respectively.

In this case, the second dequantizing unit 224 in the decoding device 200 copies a part or all of the 512 samples of spectral data in the lower frequency band as 512 samples of sample data in the higher frequency band in accordance with the sub information (position information) inputted from the second decoding unit 223.

The spectral data in the lower frequency band is copied by extracting the similar data from the spectral data outputted from the first dequantizing unit 222 based on the peak information of the spectral data in one or more scale factor bands and copying a part or all of it.

Also, the second dequantizing unit 224 adjusts the amplitude of the copied spectral data if necessary. The amplitude is adjusted by multiplying each spectral data by a predetermined coefficient, "0.5", for instance. This coefficient may be a fixed value, or may be changed for every bandwidth or scale factor band, or changed depending upon the spectral data outputted from the first dequantizing unit 222.

In the present embodiment, a predetermined coefficient is used, but this coefficient value may be added to the second encoded information as sub information. Or the scale factor value may be added to the second encoded information as a coefficient, or the quantized value of the peak in the scale factor band may be added to the second encoded information as a coefficient. The amplitude adjusting method is not limited to that mentioned above, and another method can be used.

In the present embodiment, only the position information or only the position information and the coefficient information are encoded, but the present invention is not limited to that. A scale factor, a quantized value, sign information of a spectrum, a noise generation method, and others may be encoded. Or a combination of two or more of them may be encoded.

In addition, in the present embodiment, the spectral data in the lower frequency band is copied as the spectral data of the higher frequency data. However, the present invention is not limited to that, and the spectral data in the higher frequency band may be generated from the second encoded information only.

Figure 15:
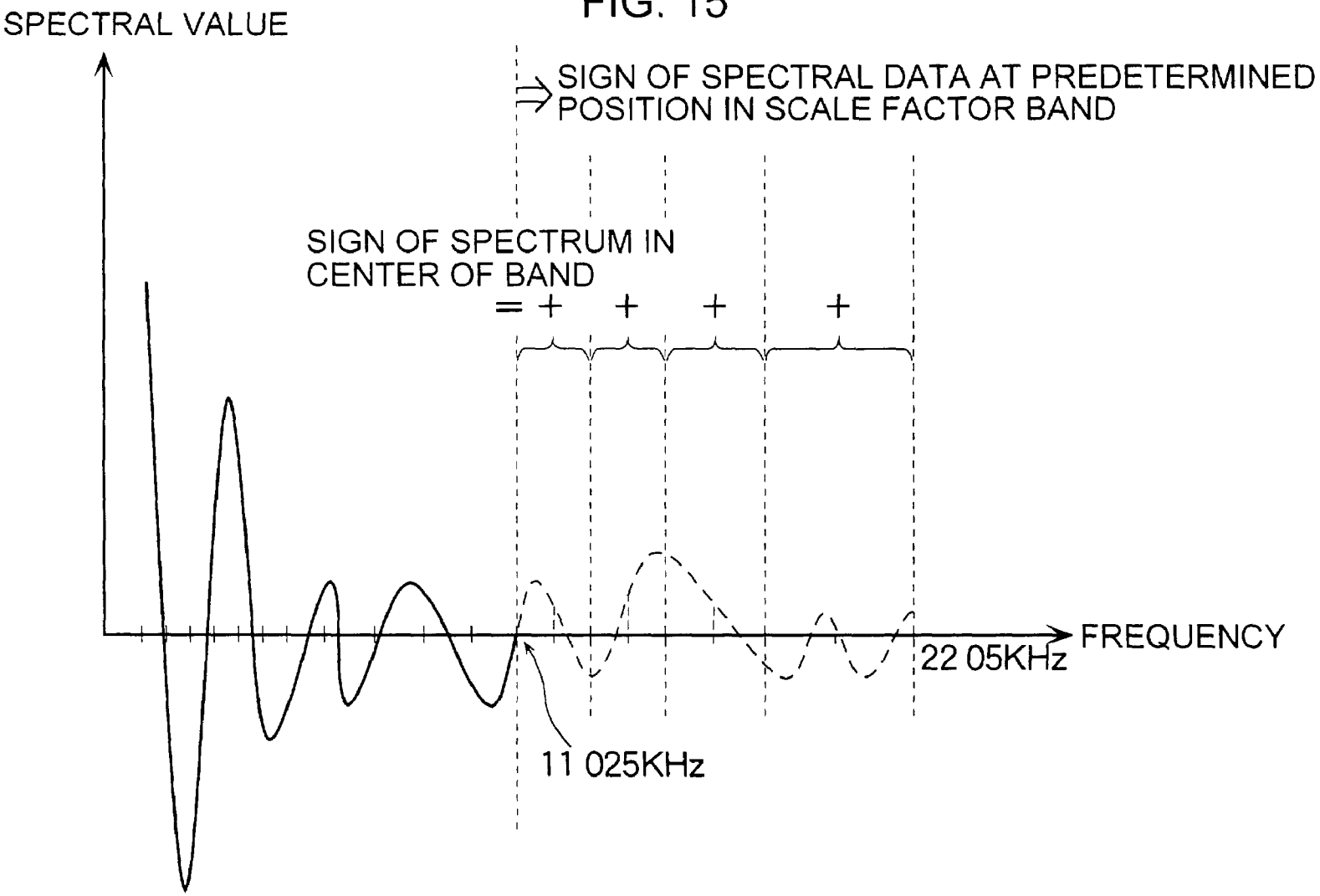
FIG. 15 shows a spectral waveform showing a concrete example of the sub information (sign information) which is generated by the second quantizing unit shown in FIG. 2.
Figure 16:
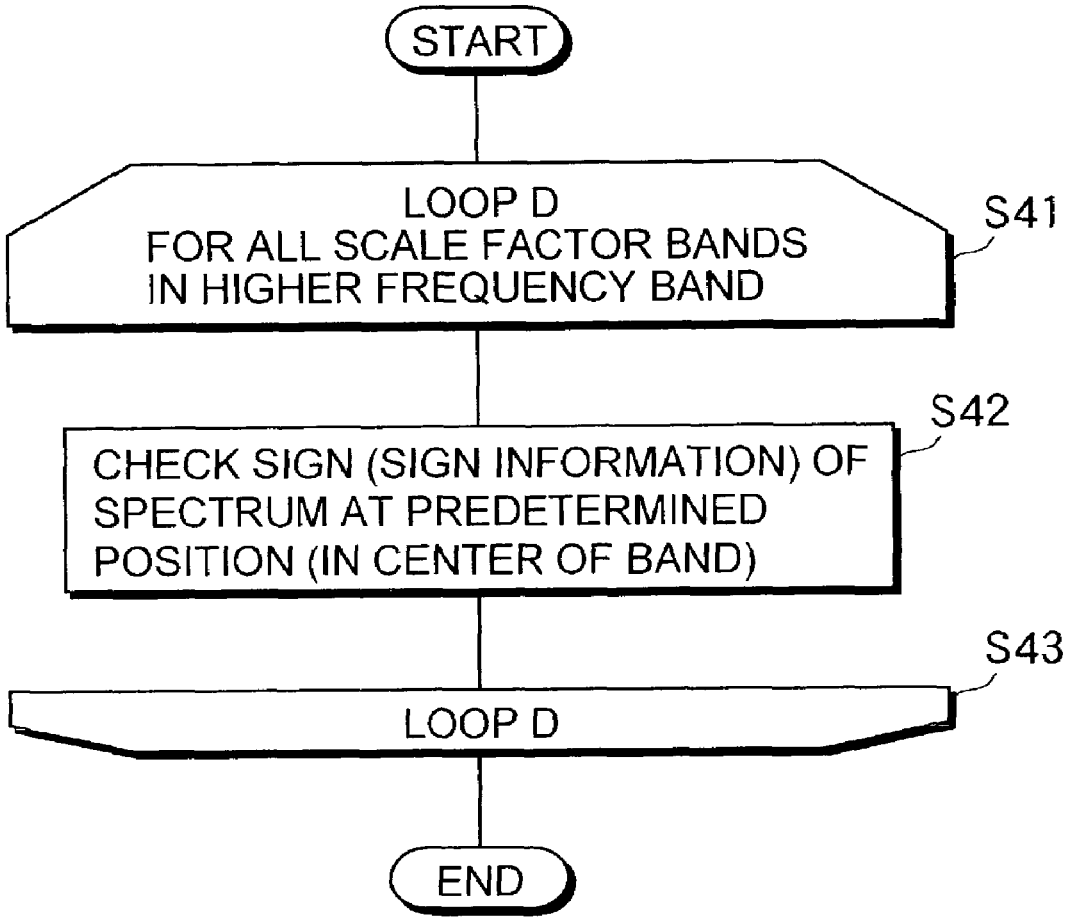
FIG. 16 is a flowchart showing an operation in a sub information (sign information) calculation processing performed by the second quantizing unit shown in FIG. 2.

FIG. 15 shows a spectral waveform showing a concrete example of the sub information (sign information) which is generated by the second quantizing unit 133 shown in FIG. 2. FIG. 16 is a flowchart showing an operation in the sub information (sign information) calculation processing performed by the second quantizing unit 133 shown in FIG. 2.

The second quantizing unit 133 specifies the sign information of the spectral data at a predetermined position, in the center, for instance, of every scale factor band in the higher frequency band having the reproduction bandwidth over 11.025 kHz up to 22.05 kHz according to the following procedure (S41).

The second quantizing unit 133 checks the sign information of the spectral data in the center position of the first scale factor band in the higher frequency band having the reproduction bandwidth over 11.025 kHz (S42), and holds the value. For example, the sign of the spectral data in the center position of the first scale factor band is "+". The second quantizing unit 133 represents this sign "+" in a value of 1 bit "1" and holds it. When the sign is "-", the second quantizing unit 133 represents it in "0" and holds it.

When the sign information of the spectral data in the center position of the first scale factor band is held (S43), the second quantizing unit 133 checks the sign of the spectral data in the center position of the next scale factor band (S42). For example, when the sign is "+", the second quantizing unit 133 holds "1" as the sign information of the spectral data in the center position of the second scale factor band.

In the same manner, the second quantizing unit 133 checks the sign "+" of the spectral data in the center position of the third scale factor band in the higher frequency band, and holds the sign information "1". The second quantizing unit 133 further checks the sign "+" of the spectral data in the center position of the fourth scale factor band, and holds the sign information "1".

When the sign information of the spectral data in the center positions of all the scale factor bands in the higher frequency band are held (S43), the second quantizing unit 133 outputs the held sign information of the scale factor bands to the second encoding unit 134 as the sub information for the higher frequency band, and ends the processing.

As described above, the second quantizing unit 133 generates the sub information (sign information). This sub information (sign information) represents the 4 scale factor bands in the higher frequency band represented in 512 samples of spectral data in sign information of 1 bit, respectively, and therefore, the spectrum in the higher frequency band can be represented with a very short data length.

In this case, the second dequantizing unit 224 in the decoding device 200 copies a part or all of the spectral data of 512 samples in the lower frequency band as the spectrum in the higher frequency band, and determines the sign of the spectral data in a predetermined position in accordance with the sign information inputted from the second decoding unit 223.

Here, the sign information indicating the sign in the center position of each scale factor band in the higher frequency band is used as sub information (sign information). However, the present invention is not limited to the center position of the scale factor band, and each peak position, the first spectral data of each scale factor band, or other predetermined positions may be used.

In the present embodiment, the position of the spectral data corresponding to the sign (sign information) to be transmitted is predetermined, but it may be changed depending upon the output of the first dequantizing unit 222, or the position information indicating the position of the sign information of each scale factor band may be added to the second encoded information and transmitted.

Also, the second dequantizing unit 224 adjusts the amplitude of the copied spectral data if necessary. The amplitude is adjusted by multiplying each spectral data by a predetermined coefficient, "0.5", for instance.

This coefficient may be a fixed value, or may be changed for every bandwidth or scale factor band, or changed depending upon the spectral data outputted from the first dequantizing unit 222. The amplitude adjusting method is not limited to this, and any other methods may be used.

In the present embodiment, a predetermined coefficient is used, but this coefficient value may be added to the second encoded information as sub information. Or the scale factor value may be added to the second encoded information as a coefficient, or a quantized value may be added to the second encoded information as a coefficient.

In the present embodiment, only the sign information, only the sign information and the coefficient information, or only the sign information and the position information are encoded, but the present invention is not limited to that. A quantized value, a scale factor, position information of a characteristic spectrum, a noise generation method, and others may be encoded. Or a combination of two or more of them may be encoded.

In addition, in the present embodiment, the spectral data in the lower frequency band is copied as the spectral data of the higher frequency data. However, the present invention is not limited to that, and the spectral data in the higher frequency band may be generated from the second encoded information only.

In the present embodiment, the sign "+" is represented in a value of 1 bit "1", and the sign "−" is represented in "0". However, the present invention is not limited to this representation of the sign in the sub information (sign information), and any other value may be used.

Figure 17A:
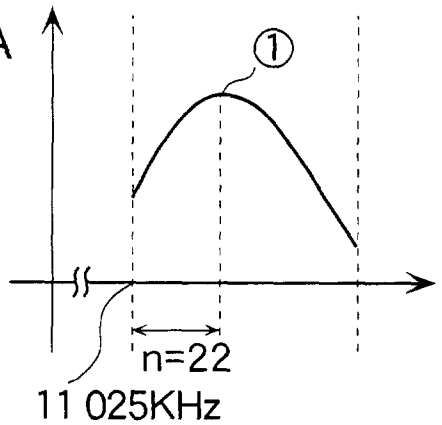
FIGS. 17A and 17B show spectral waveforms showing examples of how to create the sub information (copy information) which is generated by the second quantizing unit shown in FIG. 2.
Figure 17B:
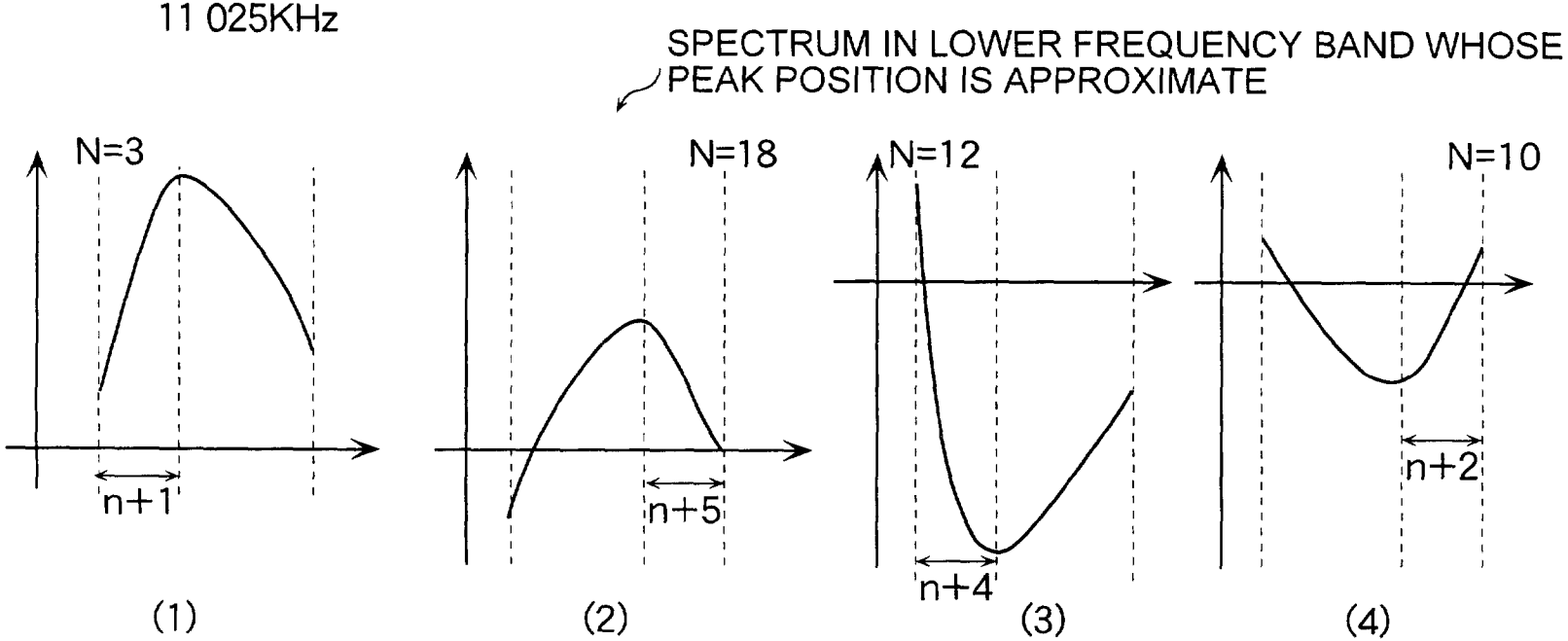
Figure 18:
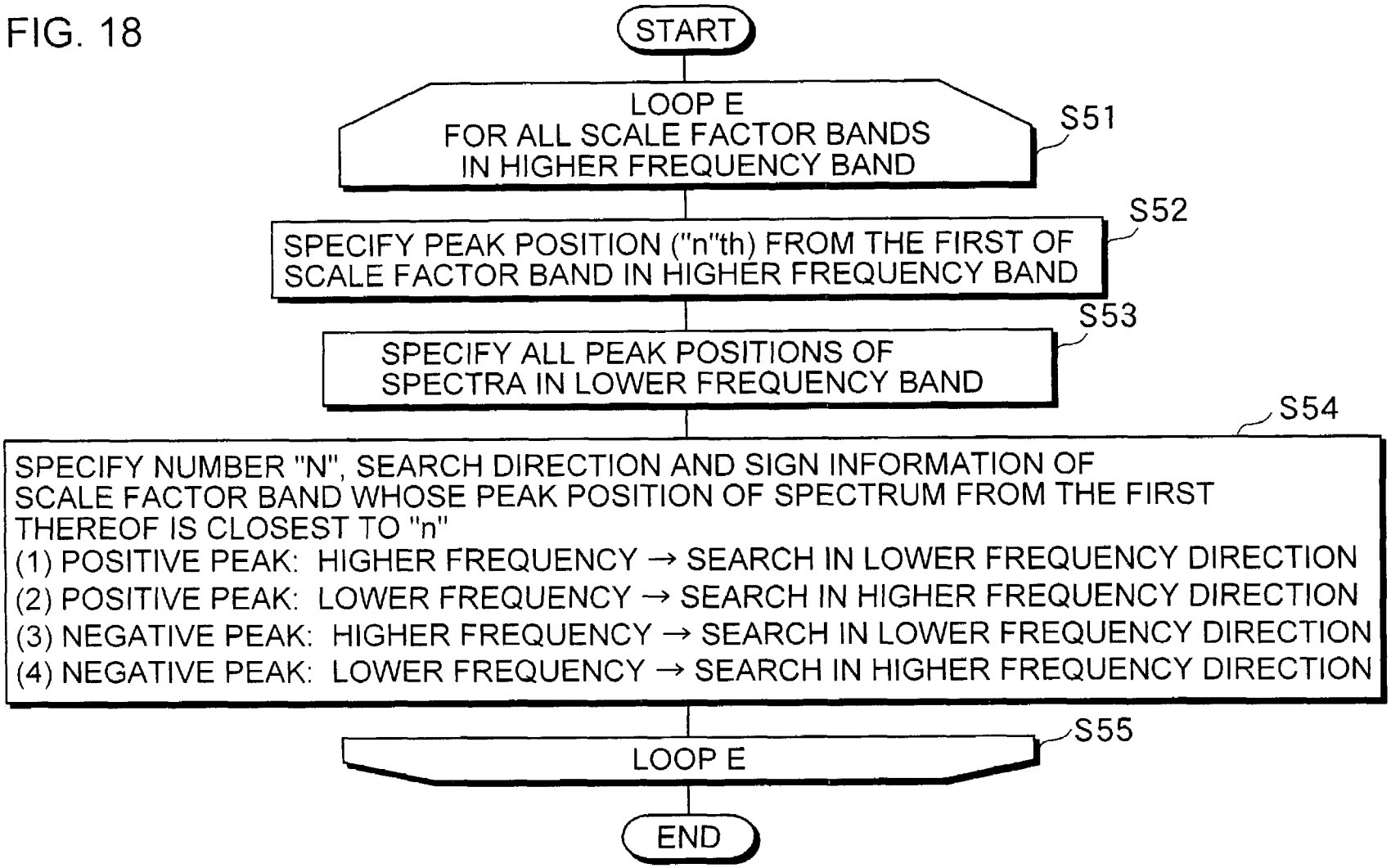
FIG. 18 is a flowchart showing an operation in a sub information (copy information) calculation processing performed by the second quantizing unit shown in FIG. 2.

FIG. 17A and FIG. 17B show spectral waveforms showing examples of how to create the sub information (copy information) which is generated by the second quantizing unit 133 shown in FIG. 2. FIG. 17A shows a spectral waveform in the first scale factor band in the higher frequency band. FIG. 17B shows examples of spectral waveforms in the lower frequency band specified with sub information (copy information). FIG. 18 is a flowchart showing an operation in the sub information (copy information) calculation processing performed by the second quantizing unit 133 shown in FIG. 2.

For every scale factor band in the higher frequency band having the reproduction bandwidth over 11.025 kHz up to 22.05 kHz, the second quantizing unit 133 specifies the number N of the scale factor band in the lower frequency band according to the following procedure (S51). The scale factor band No. N in the lower frequency band is specified because the value of the peak position of that band is closest to the peak position "n" of the scale factor band ("n"th data from the first one of the scale factor band) in the higher frequency band.

The second quantizing unit 133 specifies the absolute maximum spectra data (peak) position "n" in the first scale factor band in the higher frequency band having the reproduction bandwidth over 11.025 kHz (S52). As shown in FIG. 17A, ① indicates the specified peak "n" and the spectral data number at that position is n=22.

The second quantizing unit 133 specifies the peak positions of all the spectra (including both positive and negative spectra) in the lower frequency band having the reproduction bandwidth of 11.025 kHz or less (S53).

Next, for every specified peak in the lower frequency band, the second quantizing unit 133 searches for the scale factor band whose peak position from the first thereof is closest to "n", and specifies the number N of that scale factor band, the search direction and the sign information of the peak (S54).

Specifically, for every specified peak (including both positive and negative) in the lower frequency band, the second quantizing unit 133 searches for the first of the scale factor band whose peak position is closest to "n" sequentially from the lower frequency side. There are two search directions: (1) search from the peak in the lower frequency direction, and (2) search from the peak in the higher frequency direction. In addition, as for the peaks in the lower frequency band whose positive and negative signs are inverted from those in the higher frequency band, there are also two search directions; (3) search from the peak in the lower frequency direction, and (4) search from the peak in the higher frequency direction.

In the case of the search directions (2) and (4), when the spectral waveform in the lower frequency band is copied based on the peak information, the peak position in the higher frequency band and the peak position in the lower frequency band are inverted from side to side (in the frequency axis direction), as shown in FIG. 17B. Therefore, it is necessary to attach information indicating the search direction (forward and reverse) when (1) and (3) are the forward search direction and (2) and (4) are the reverse search direction, for instance. Also, in the case of the search directions (3) and (4), the peak position in the higher frequency band and the peak position in the lower frequency band are inverted up and down (in the vertical axis direction), as shown in FIG. 17B. Therefore, it is necessary to attach information indicating whether the positive and negative signs of the peak values of the higher and lower frequency bands are inverted or not.

The second quantizing unit 133 makes searches in the four directions, that is, in the search directions (1) and (2) if the peak value specified in the lower frequency band is positive, and in the search directions (3) and (4) if the peak value is negative, and then specifies the number of the scale factor band whose peak position is closest to "n" among the search results. In this case, a certain value, "5", for instance, is predetermined as a tolerance between "n" and the actual peak position, the second quantizing unit 133 selects the scale factor band whose peak position is closest to "n" among the four kinds of search results, and specifies the number N of that scale factor band. In addition, it specifies the sign information indicating whether the signs of the peak values in the higher frequency band and the lower frequency band are inverted or not and the information indicating the search direction (forward or reverse).

For example, in the search direction (1), the number N=3 of the scale factor band is specified with tolerance from the peak position of "1" for the spectrum in the lower frequency band as shown in FIG. 17B (1). Similarly, in the search directions (2), (3) and (4), the numbers N=18, N=12 and N=10 of the scale factor bands are specified with tolerances from the peak positions of "5", "4" and "2" for the spectra in the lower frequency bands as shown in FIG. 17B (2), (3) and (4), respectively. The second quantizing unit 133 selects the number N=3 of the scale factor band whose peak position is closest to "n" with tolerance from the peak position of "1", among these specified four numbers of the scale factor bands. In addition, it generates the sign information "1" indicating the sign "+" of the peak in the lower frequency band and the search direction information "1" indicating the search in the lower frequency direction. In this case, if the sign of the peak is "−", the sign information is "0", and if the search is performed in the higher frequency direction, the search direction information is "0".

When the scale factor band number N=3, the sign information "1" and the search direction information "1" are specified for the first scale factor band in the higher frequency band (S55), the second quantizing unit 133 specifies the number N, the sign information and the search direction information of the next scale factor band in the same manner as above.

In this manner, the number N, the sign information and the search direction information of every scale factor band in the lower frequency band whose peak position from the first thereof is closest to the peak position "n" from the first of the scale factor band in the higher frequency band (S55). Then, the second quantizing unit 133 outputs the specified number N, the sign information and the search direction information of the scale factor band in the lower frequency band corresponding to each scale factor band in the higher frequency band to the second encoding unit 134 as the sub information (copy information) for the higher frequency band, and ends the processing.

In this case, if the first encoded signal is decoded according to the conventional procedure in the decoding device 200, the spectral data of 512 samples of the lower frequency side can be obtained. The second dequantizing unit 224 copies a part or all of the spectral data corresponding to the scale factor band numbers outputted from the second decoding unit 223 as the spectra in the higher frequency band. The second dequantizing unit 224 adjusts the amplitude of the copied spectral data if necessary. The amplitude is adjusted by multiplying each spectrum by a predetermined coefficient, 0.5, for instance.

This coefficient may be a fixed value, or may be changed for every scale factor band or depending upon the spectral data outputted from the first dequantizing unit 222.

In the present embodiment, a predetermined coefficient is used, but this coefficient value may be added to the second encoded information as sub information. Or the scale factor value may be added to the second encoded information as a coefficient, or the quantized value may be added to the second encoded information as a coefficient. Also, the amplitude adjusting method is not limited to the above, and any other methods may be used.

In the present embodiment, the sign information and the search direction information as well as the number N of the scale factor band are extracted as the sub information (copy information) for the higher frequency band. However, the sign information and the search direction information may be omitted depending upon the transmittable information amount in the higher frequency band. Also, the sign information is represented as "1" when the sign of the peak in the lower frequency band is "+", and it is represented as "0" when the sign is "−". The search direction information is represented as "1" when the search is made from the peak in the lower frequency direction, and it is represented as "0" when the search is made from the peak in the higher frequency direction. However, the sign of the peak in the lower frequency band in the sign information and the search direction in the search direction information are not limited to those, and they may be represented in other values.

Also, in the present embodiment, the first of the scale factor band in the lower frequency band whose specified peak position from the first is closest to "n" is searched. However, the present invention is not limited to that, and the peak whose position from the first of each scale factor band in the lower frequency band is closest to "n" may be searched.

Figure 19:
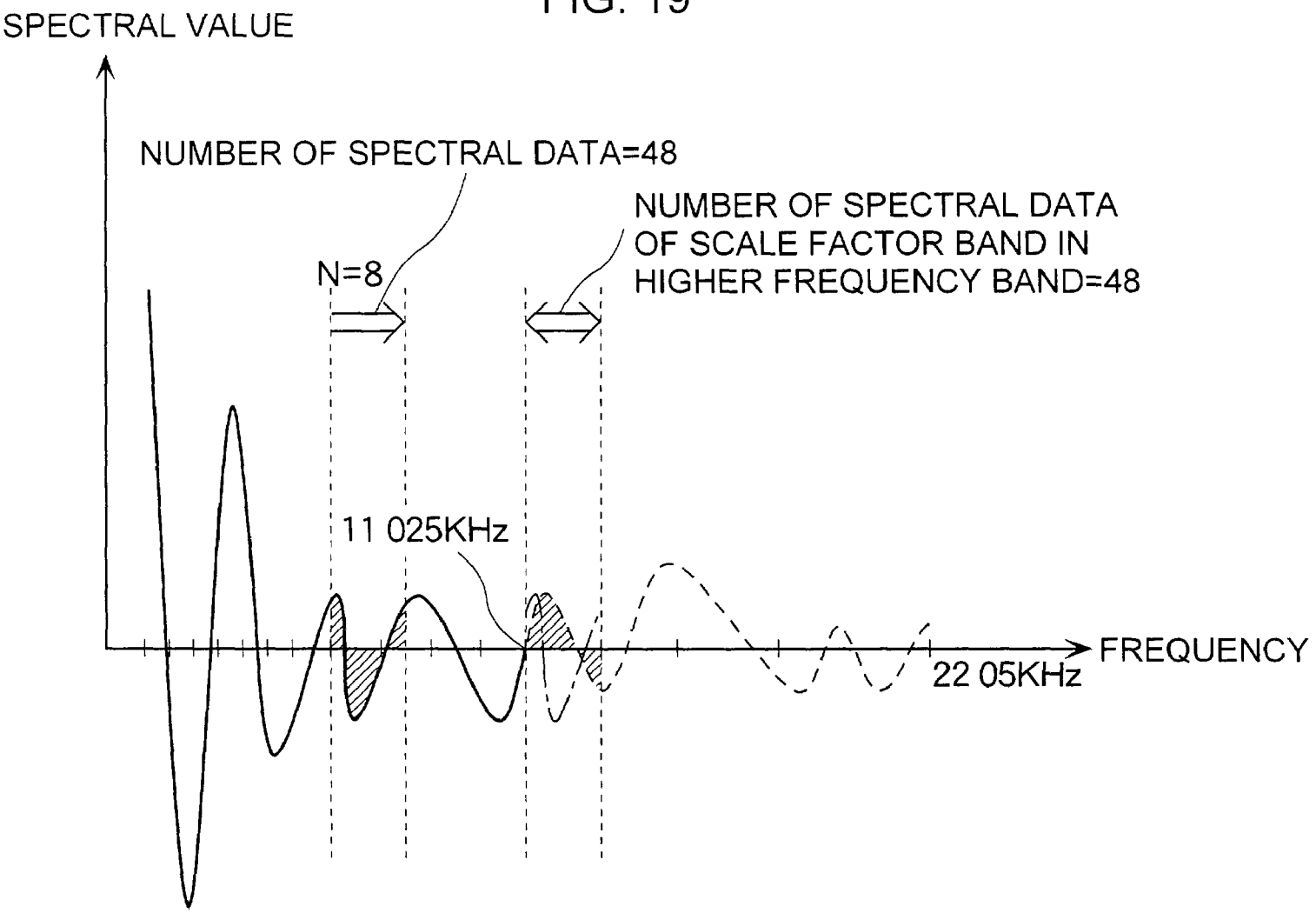
FIG. 19 shows a spectral waveform showing the second example of how to create the sub information (copy information) which is generaged by the second quantizing unit shown in FIG. 2.
Figure 20:
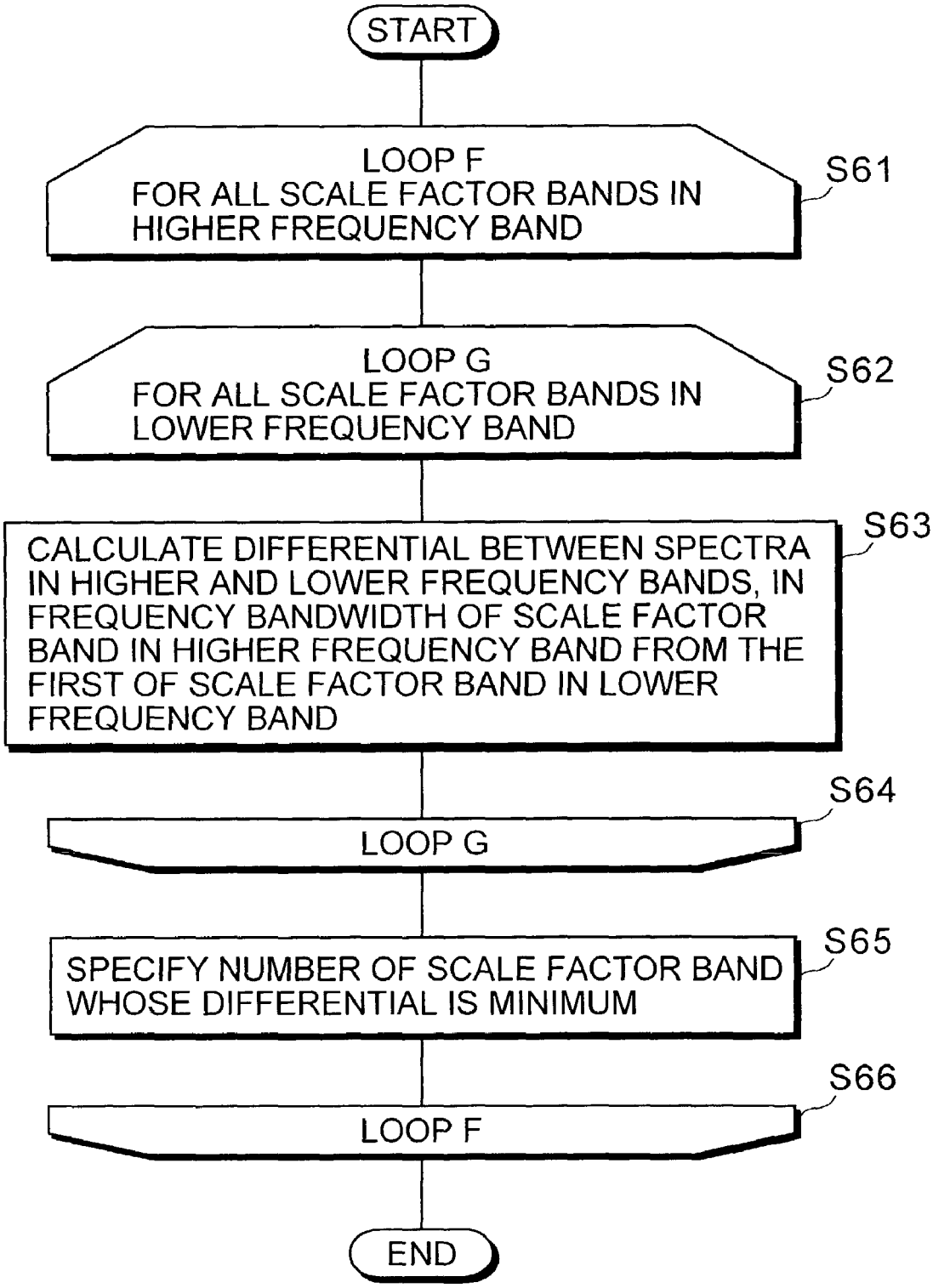
FIG. 20 is a flowchart showing an operation in the second sub information (copy information) calculation processing performed by the second quantizing unit shown in FIG. 2.

FIG. 19 shows a spectral waveform showing the second example of how to create the sub information (copy information) which is generated by the second quantizing unit 133 shown in FIG. 2. FIG. 20 is a flowchart showing an operation in the second sub information (copy information) calculation processing performed by the second quantizing unit 133 shown in FIG. 2.

For every scale factor band in the higher frequency band having the reproduction bandwidth over 11.025 kHz up to 22.05 kHz, the second quantizing unit 133 specifies the number N of the scale factor band in the lower frequency band whose differential (energy differential) from each spectrum in the scale factor band in the higher frequency band is minimum, according to the following procedure (S61). In this case, the number of spectral data in the lower frequency band is equal to the number of spectral data in the higher frequency band, and the number N of the specified scale factor band indicates the number of the first of that scale factor band.

For every scale factor band in the lower frequency band (S62), the second quantizing unit 133 calculates the differential between the spectra in the higher frequency band and those in the lower frequency band, in the frequency bandwidth comprising the same number of spectral data as that of the scale factor band in the higher frequency band, from the first data of the scale factor band in the lower frequency band (S63). For example, in the waveform as shown in FIG. 19, if the first scale factor band of the higher frequency band comprises 48 samples of spectral data, the second quantizing unit 133 calculates the differentials of the 48 spectral data between the higher frequency band and the lower frequency band, in sequence, from the first data of the scale factor band of number N=1 in the lower frequency band.

When the second quantizing unit 133 calculates the differential of the spectra between the higher frequency band and the lower frequency band (S65), it holds the value, and then calculates, for the next scale factor band, the differential of the spectra between the higher frequency band and the lower frequency band, in the frequency bandwidth comprising the same number of spectral data as that in the scale factor band in the higher frequency band from the first of the next scale factor band in the lower frequency band (S64). For example, when the differential of the spectra from the first of the scale factor band of number N=1 in the lower frequency band is calculated in the width of 48 samples of spectral data, the second quantizing unit 133 holds the value of the calculated differential, and further calculates the differential of the spectra from the first of the scale factor band of number N=2 in the lower frequency band in the width of 48 samples of spectral data. In the same way, the second quantizing unit 133 calculates the differential of the spectra by sequentially summing up the differentials of 48 spectral data between the higher frequency band and the lower frequency band, for all scale factor bands in the lower frequency band from numbers N=3, 4, . . . 28 (the last scale factor band in the lower frequency band).

For all the scale factor bands in the lower frequency band, the second quantizing unit 133 calculates the differentials of the spectra between the higher frequency band and the lower frequency band, in the width of the same number of spectral data as that in the higher frequency band from the first of the scale factor band in the lower frequency band (S64). Then, the second quantizing unit 133 specifies the number N of the scale factor band in which the calculated differential is minimum (S65). For example, in the spectral waveform as shown in FIG. 19, the scale factor band of number N=8 in the lower frequency band is specified. In this figure, it is indicated that the differentials between the spectral data in the lower frequency band in shaded portions and the spectral data in the higher frequency band in shaded portions are minimum and the energy differential between both spectra is minimum. In other words, if 48 samples of spectral data from the first of the scale factor band of number N=8 are copied to the first scale factor band in the higher frequency band over 11.025 kHz, they become a waveform indicated by an alternate long and short dashed line in the higher frequency band in FIG. 19, and therefore, the energy in the corresponding scale factor band in the higher frequency band can be represented approximately to the original spectrum.

When the second quantizing unit 133 specifies the number N of the scale factor band in the lower frequency band whose differential from the spectrum of the scale factor band in the higher frequency band is minimum, it holds the number N of the specified scale factor band, and then specifies the number N of the scale factor band in the lower frequency band corresponding to the next scale factor band in the higher frequency band (S66). The second quantizing unit 133 repeats this processing in sequence, and when it specifies all the numbers N of the scale factor bands in the lower frequency band whose differentials from the spectra in the higher frequency band are minimum, it outputs the held numbers N of the scale factor bands in the lower frequency band to the second encoding unit 134 as the sub information (copy information) for the higher frequency band, and ends the processing.

In the present embodiment, the method of copying the spectra in the lower frequency band by the decoding device 200 and adjusting the amplitude thereof are same as the case for the sub information (copy information) described with reference to FIG. 17 and FIG. 18.

In the flowchart of FIG. 20, the energy differentials of the same sign of spectral data between the higher frequency band and the lower frequency band are calculated in the same direction on the frequency axis. However, the encoding device of the present invention is not limited to that, and they may be calculated using any one of the following three methods, as described using FIG. 17 and FIG. 18: ① as for the spectral data in the higher frequency band which has the same sign and is sequentially selected in the direction from the lower frequency band to the higher frequency band, the same number of spectral data in the lower frequency band are sequentially selected from the first of the scale factor band in the lower frequency band in the direction from the higher frequency band to the lower frequency band (in the reverse direction on the frequency axis), and the differentials of the spectra are calculated, ② the signs of the spectra in the lower frequency band are inverted (multiplied by negative) and calculated in the same direction on the frequency axis, and ③ the signs of the spectra in the lower frequency band are inverted (multiplied by negative) and calculated in the reverse direction on the frequency axis. Or, after the calculations of the energy differentials are made according to all of the four methods, the number N of the scale factor band in the lower frequency band including the spectrum whose energy differential is minimum may be the sub information. In that case, in order to copy accurately the spectrum in the lower frequency band whose energy differential is minimum to the higher frequency band, the information indicating the relationship between the signs of the spectra of the higher and lower frequency bands and the information indicating the copying direction on the frequency axis are inserted into the sub information for every scale factor band. The information indicating the relationship between the signs of the spectra of the higher and lower frequency bands is represented by 1 bit, "1" for the differential of the spectra calculated with the same sign, and "0" for the differential of the spectra calculated with reverse signs, for instance. Also, the information indicating the direction on the frequency axis of copying the spectrum in the lower frequency band to the higher frequency band is represented by 1 bit, "1" for the forward copying direction, that is, the forward direction of selecting the spectral data in the higher and lower frequency bands, and "0" for the reverse copying direction, that is, the reverse direction of selecting the spectral data in the higher and lower frequency bands, for instance.

Figure 21:
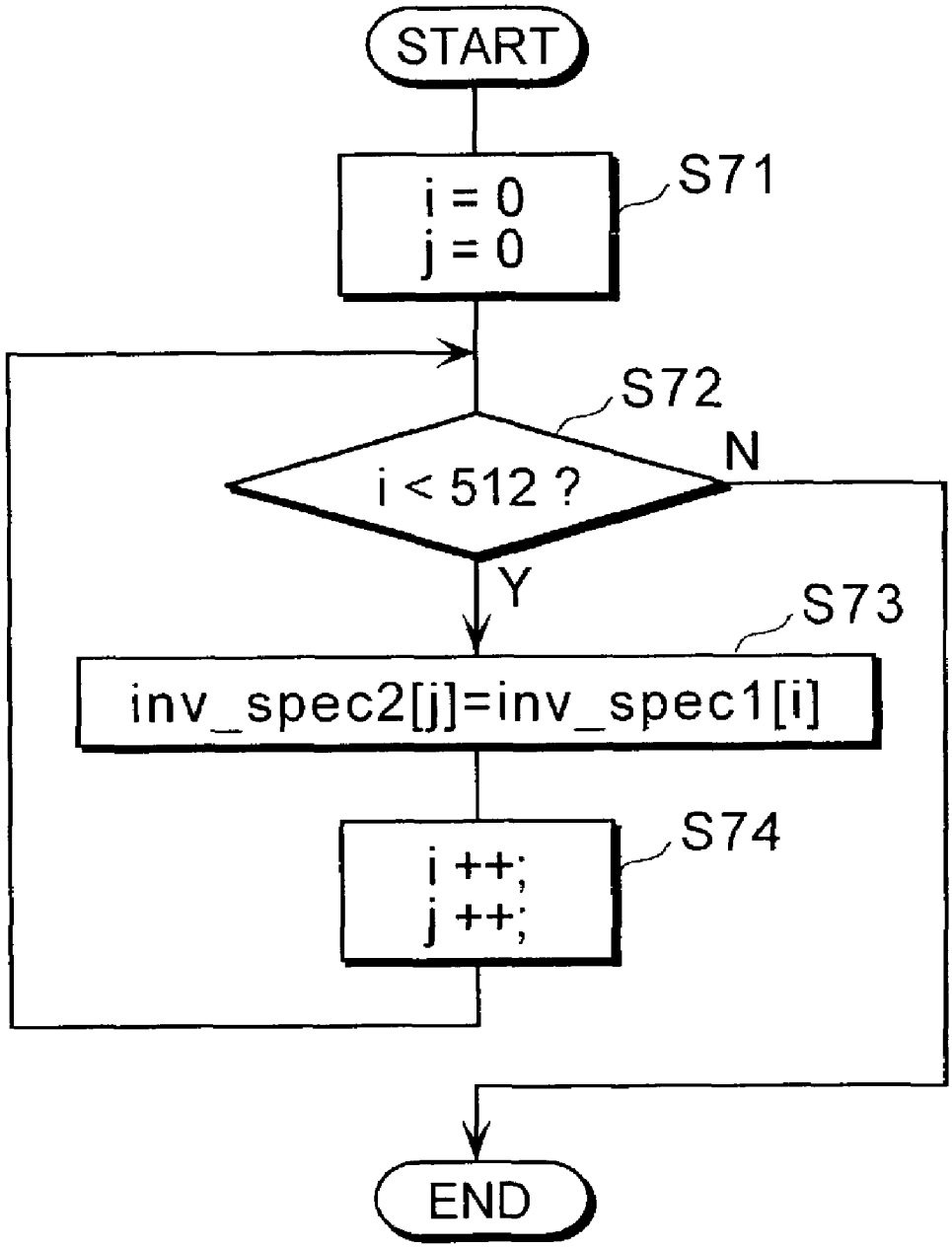
FIG. 21 is a flowchart showing a procedure by which the second dequantizing unit shown in FIG. 2 copies 512 spectra in the lower frequency band to the higher frequency band in the forward direction.

FIG. 21 is a flowchart showing a procedure by which the second dequantizing unit 224 shown in FIG. 2 copies a spectrum of 512 samples in the lower frequency band to the higher frequency band in the forward direction. In FIG. 21, inv_spec1[i] indicates a value of the ith spectrum among the output data from the first dequantizing unit 222, and inv_spec2[j] indicates a value of the jth spectrum among the input data into the second dequantizing unit 224.

First, the second dequantizing unit 224 sets the initial values of a counter i and a counter j to be "0", respectively, which count the number of spectral data, in order to input the spectral data of 0th through 511th in the same direction (S71). Next, the second dequantizing unit 224 checks whether the value of the counter i is less than "512" or not (S72). When the value of the counter i is less than "512", the second dequantizing unit 224 inputs the value of the ith (0th in this case) spectral data in the lower frequency band of the first dequantizing unit 222 as the value of the jth (0th in this case) spectral data in the higher frequency band of the second dequantizing unit 224 (S73). Then, the second dequantizing unit 224 increments the values of the counters i and j by "1" respectively (S74), and checks whether the value of the counter i is less than "512" or not (S72).

The second dequantizing unit 224 repeats the above processing while the value of the counter i is less than "512", and ends the processing when the value becomes "512" or more.

As a result, all the 0th~511th spectral data in the lower frequency band that are the results of dequantization by the first dequantizing unit 222 are copied as they are as the spectral data in the higher frequency band of the second dequantizing unit 224.

Figure 22:
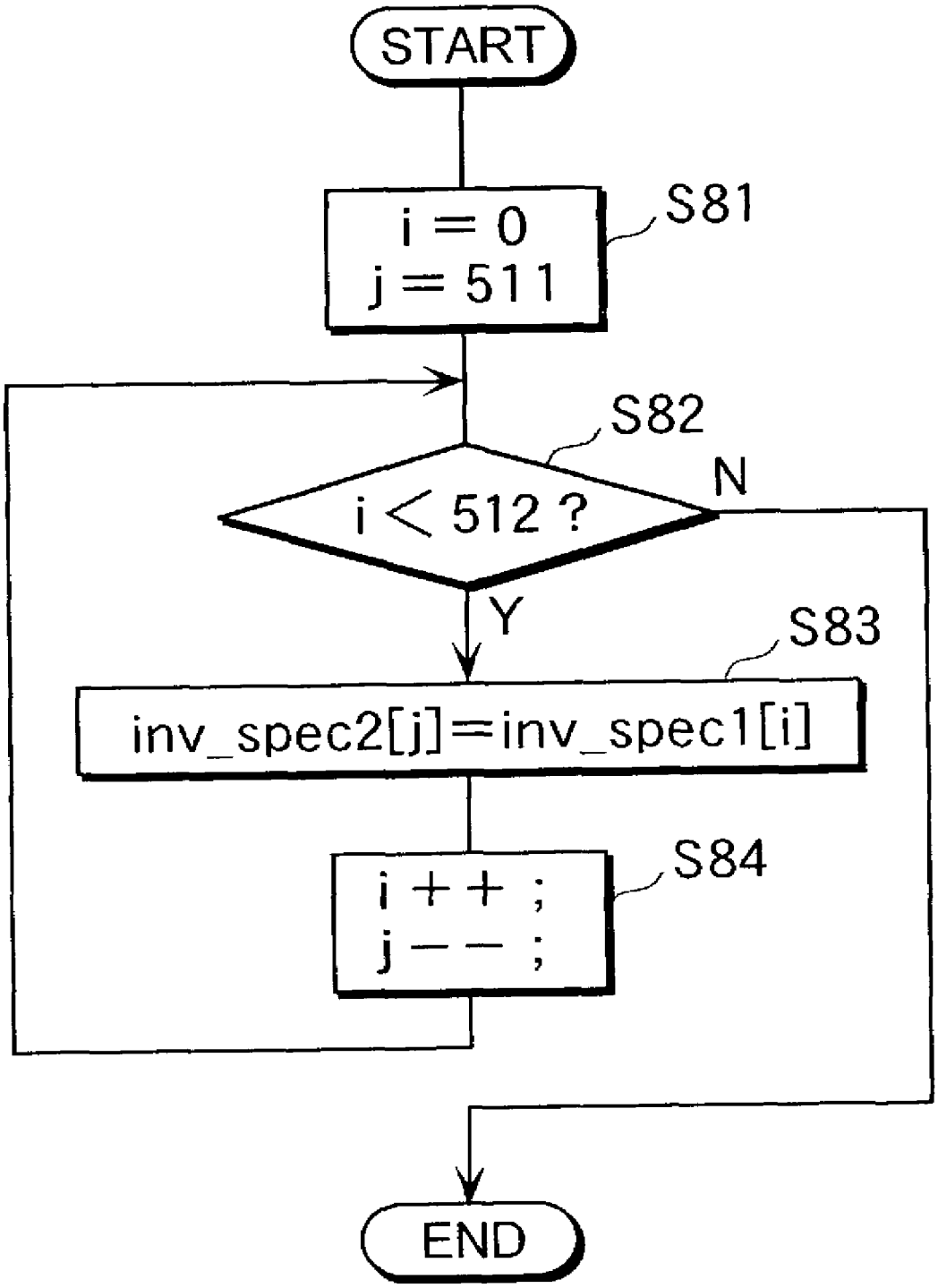
FIG. 22 is a flowchart showing a procedure by which the second dequantizing unit shown in FIG. 2 copies 512 spectra in the lower frequency band to the higher frequency band in the reverse direction of the frequency axis.

FIG. 22 is a flowchart showing a procedure by which the second dequantizing unit 224 shown in FIG. 2 copies a spectrum of 512 samples in the lower frequency band to the higher frequency band in reverse direction on the frequency axis. In FIG. 22, inv_spec1[i] indicates a value of the *i*th spectral data among the output data from the first dequantizing unit 222, and inv_spec2[j] indicates a value of the *j*th spectral data among the input data into the second dequantizing unit 224.

First, the second dequantizing unit 224 sets the initial value of a counter i to be "0" and the value of a counterj to be "511", which count the number of spectral data, in order to input the spectral data of 0th through 511th in the reverse direction (S81). Next, the second dequantizing unit 224 checks whether the value of the counter i is less than "512" or not (S82). When the value of the counter i is less than "512", the second dequantizing unit 224 inputs the value of the ith (0th in this case) spectral data in the lower frequency band of the first dequantizing nit 222 as the value of the *j*th (511th in this case) spectral data in the higher frequency band of the second dequantizing unit 224 (S83). Then, the second dequantizing unit 224 increments the value of the counter i by "1" and decrements the value of the counter j by "1" (S84), and checks whether the value of the counter i is less than "512" or not (S82).

The second dequantizing unit 224 repeats the above processing while the value of the counter i is less than "512", and ends the processing when the value becomes "512" or more.

As a result, all the 0th~511th spectral data in the lower frequency band that are the results of dequantization by the first dequantizing unit 222 are copied in the reverse direction as the 511th~0th spectral data in the higher frequency band of the second dequantizing unit 224.

In the present embodiment, the second dequantizing unit 224 copies all the spectral data in the lower frequency band to the higher frequency band, but it may copy only a part of them. Examples of procedures of copying the higher frequency band and the lower frequency band all at once are described with reference to FIG. 21 and FIG. 22. However, a part of them may be copied according to the procedure shown in FIG. 21 and another part of them may be copied according to the procedure shown in FIG. 22. Also, a part or all of them may be copied by inverting the positive and negative signs thereof.

These copying procedures may be predetermined, or may be changed depending upon the data in the lower frequency band, or may be transmitted as the sub information.

In the present embodiment, the spectral data in the lower frequency band is copied as that in the higher frequency band, but the present invention is not limited to that, and the spectral data in the higher frequency band may be generated only from the second encoded information.

In the present embodiment, 512 samples in the lower frequency band out of all the spectral data are encoded as the first encoded signal, and the other samples are encoded as the second encoded signal, but the present invention is not limited to that allocation.

In the present embodiment, as for the noise generation in the second dequantizing unit 224, the case where the spectral data obtained mainly from the first dequantizing unit 222 is copied is described. However, the present invention is not limited to that, and spectral data, white noise, pink noise and so on having a certain value in each scale factor band in the higher frequency band may be generated in the second dequantizing unit 224 in its own way, or may be generated according to the sub information.

In the present embodiment, one sub information is encoded for each scale factor band as a second encoded signal, but one sub information may be encoded for two or more scale factor bands, or two or more sub information may be encoded for one scale factor band.

In the present embodiment, the sub information may be encoded for every channel, or one sub information may be encoded for two or more channels.

In the present embodiment, the encoding device 100 includes two quantizing units and two encoding units. However, the present invention is not limited to that, and it may include three or more quantizing units and encoding units, respectively.

In the present embodiment, the decoding device 200 includes two decoding units and two dequantizing units. However, the present invention is not limited to that, and it may include three or more decoding units and dequantizing units, respectively.

In the present embodiment, the case where the transforming unit 120 divides the transformed spectral data into the number of scale factor bands and delimitation thereof which are determined of its own is described. However, the present invention is not limited to that, and the transforming unit may divide the transformed spectral data into the scale factor bands according to the AAC standard. By dividing them into the scale factor bands according to the AAC standard, the conventional decoding device 400 can also decode the bit stream encoded by the encoding device 100 of the present invention without any problem and obtain the digital audio output data as usual.

The above-mentioned processing can be realized by software as well as hardware, and the present invention may be configured so that a part of the processing is realized by hardware and the other processing is realized by software.

The present embodiment is described on the assumption that the sampling frequency is 44.1 kHz and the digital audio data for one frame comprises 1,024 samples. However, the encoding device and the decoding device of the present invention are not limited to that, and sampling frequency of any Hz may be used.

INDUSTRIAL APPLICABILITY

The encoding device according to the present invention is useful as an audio encoding device that is placed in a satellite broadcast station including broadcasting satellite (BS) and communication satellite (CS), as an audio encoding device of a content distribution server that distributes a content via a communication network such as the Internet, and further as a program for encoding an audio signal that is executed by a general-purpose computer.

The decoding device according to the present invention is useful not only as an audio decoding device included in a set-top box (STB) for home use, but also as a program for decoding an audio signal that is executed by a general-purpose computer, as a circuit board, LSI and so on which are included in STB or a general-purpose computer and exclusively used for decoding an audio signal, and as an IC card inserted into an STB or a genera-purpose computer.

The invention claimed is:

1. An encoding device that encodes an inputted audio signal, the encoding device comprising:

a first encoding unit operable to encode spectral data in a lower frequency band out of spectral data which is obtained by transforming the audio signal inputted for a fixed time length and divided into a plurality of groups, the spectral data in the lower frequency band being represented by four parameters, the four parameters including (1) a normalizing factor for normalizing the spectral data in each of the groups of the lower frequency band, (2) a quantized value obtained by quantizing the spectral data in each of the groups of the lower frequency band using the normalizing factor, (3) a positive or negative sign indicating a phase of the spectral data in each of the groups of the lower frequency band, and (4) a position of the spectral data in each of the groups of the lower frequency band in a frequency domain;

a sub information generating unit operable to generate sub information including:

(1) specification information for specifying a spectrum in the lower frequency band in which a difference is minimum between (a) a distance in the frequency domain, for each of the groups of the higher frequency band, from a boundary of the group to a peak of a spectrum in the group and (b) a distance in the frequency domain, for each of the groups of the lower frequency band, from a boundary of the group to a peak of a spectrum in the group, as information for specifying spectral data in the lower frequency band which is approximate to the spectral data in each of the groups of the higher frequency band; and (2) correction information indicating a characteristic of the spectral data in the higher frequency band which is represented by three or less of the four parameters, as information for correcting the specified spectral data in the lower frequency band;

a second encoding unit operable to encode the generated sub information; and an outputting unit operable to output the data encoded by the first encoding unit and the data encoded by the second encoding unit.

2. An encoding device that encodes an inputted audio signal, the encoding device comprising:

a first encoding unit operable to encode spectral data in a lower frequency band out of spectral data which is obtained by transforming the audio signal inputted for a fixed time length and divided into a plurality of groups, the spectral data in the lower frequency band being represented by four parameters, the four parameters including (1) a normalizing factor for normalizing the spectral data in each of the groups of the lower frequency band, (2) a quantized value obtained by quantizing the spectral data in each of the groups of the lower frequency band using the normalizing factor, (3) a positive or negative sign indicating a phase of the spectral data in each of the groups of the lower frequency band, and (4) a position of the spectral data in each of the groups of the lower frequency band in a frequency domain;

a sub information generating unit operable to generate sub information including:

(1) specification information for specifying a spectrum in the lower frequency band whose differential value of energy obtained in a same frequency bandwidth as that of the spectrum in a corresponding group of the higher frequency band is minimum, as information for specifying spectral data in the lower frequency band which is approximate to the spectral data in each of the groups of the higher frequency band; and (2) correction information indicating a characteristic of the spectral data in the higher frequency band which is represented by three or less of the four parameters, as information for correcting the specified spectral data in the lower frequency band;

a second encoding unit operable to encode the generated sub information; and an outputting unit operable to output the data encoded by the first encoding unit and the data encoded by the second encoding unit.

3. An encoding device that encodes an inputted audio signal, the encoding device comprising:

a first encoding unit operable to encode spectral data in a lower frequency band out of spectral data which is obtained by transforming the audio signal inputted for a fixed time length and divided into a plurality of groups, the spectral data in the lower frequency band being represented by four parameters, the four parameters including (1) a normalizing factor for normalizing the spectral data in each of the groups of the lower frequency band, (2) a quantized value obtained by quantizing the spectral data in each of the groups of the lower frequency band using the normalizing factor, (3) a positive or negative sign indicating a phase of the spectral data in each of the groups of the lower frequency band, and (4) a position of the spectral data in each of the groups of the lower frequency band in a frequency domain;

a sub information generating unit operable to generate sub information including:

(1) specification information for specifying a spectrum in the lower frequency band whose differential value of energy obtained in a same frequency bandwidth as that of the spectrum in a corresponding group of the higher frequency band is minimum, as information for specifying spectral data in the lower frequency band which is approximate to the spectral data in each of the groups of the higher frequency band; and (2) correction information indicating a characteristic of the spectral data in the higher frequency band which is represented by three or less of the four parameters, as information for correcting the specified spectral data in the lower frequency band;

a second encoding unit operable to encode the generated sub information; and an outputting unit operable to output the data encoded by the first encoding unit and the data encoded by the second encoding unit, wherein the specification information is represented by a number specifying the group to which the specified spectrum in the lower frequency band belongs.

4. A decoding device that receives encoded data including first encoded data and second encoded data, and decodes the received encoded data, wherein the first encoded data is obtained by encoding spectral data in a lower frequency band out of spectral data which is obtained by transforming the audio signal inputted for a fixed time length and divided into a plurality of groups, the spectral data in the lower frequency band being represented by four parameters, the four parameters including (1) a normalizing factor for normalizing the spectral data in each of the groups of the lower frequency band, (2) a quantized value obtained by quantizing the spectral data in each of the groups of the lower frequency band using the normalizing factor, (3) a positive or negative sign indicating a phase of the spectral data in each of the groups of the lower frequency band, and (4) a position of the spectral data in each of the groups of the lower frequency band in a frequency domain;

wherein the second encoded data is obtained by encoding sub information including (1) specification information for specifying spectral data in the lower frequency band which is approximate to the spectral data in each of the groups of the higher frequency band, and (2) correction information indicating a characteristic of the spectral data in the higher frequency which is represented by three or less of the four parameters, as information for correcting the specified spectral data in the lower frequency band;

wherein the decoding device comprises:

an encoded data separating unit operable to separate the second encoded data from the received encoded data;

a first decoding unit operable to decode the first encoded data out of the received encoded data, and output spectral data indicating the lower frequency band;

a second decoding unit operable to decode the second encoded data which is separated from the received encoded data, copy spectral data in the lower frequency band specified based on the specification information in the sub information, out of the spectral data outputted by the first decoding unit, into each of the groups of the higher frequency band, correct the copied spectral data based on the correction information in the sub information, and thereby generate spectral data indicating the higher frequency band, and further correct the generated spectral data in the higher frequency band by amplifying the generated spectral data with a previously held predetermined gain of amplitude, and thereby output the corrected spectral data in the higher frequency band; and an audio signal outputting unit operable to integrate the spectral data outputted by the first decoding unit and the spectral data outputted by the second decoding unit, transform the integrated data, and output the transformed data as an audio signal in a time domain.

* * * * *

UNITED STATES PATENT AND TRADEMARK OFFICE

CERTIFICATE OF CORRECTION

PATENT NO. : 7,283,967 B2
APPLICATION NO. : 10/285609
DATED : October 16, 2007
INVENTOR(S) : Kosuke Nishio et al.

It is certified that error appears in the above-identified patent and that said Letters Patent is hereby corrected as shown below:

Column 29,
Line 24, "frequency which" should read --frequency band which--.

Signed and Sealed this

Twenty-ninth Day of April, 2008

JON W. DUDAS
*Director of the United States Patent and Trademark Office*